US010446065B2

(12) United States Patent
Quaal et al.

(10) Patent No.: US 10,446,065 B2
(45) Date of Patent: Oct. 15, 2019

(54) SIGN BOX LIGHTING SYSTEM

(71) Applicant: The Sloan Company, Inc., Ventura, CA (US)

(72) Inventors: Bruce Quaal, Ventura, CA (US); Timothy Drew Ferrie, Ojai, CA (US); Aaron Meyer, Ventura, CA (US); Chad Chu, Camarillo, CA (US)

(73) Assignee: The Sloan Company, Inc., Ventura, CA (US)

( * ) Notice: Subject to any disclaimer, the term of this patent is extended or adjusted under 35 U.S.C. 154(b) by 427 days.

(21) Appl. No.: 14/100,983

(22) Filed: Dec. 9, 2013

(65) Prior Publication Data

US 2014/0268785 A1 Sep. 18, 2014

Related U.S. Application Data

(60) Provisional application No. 61/794,517, filed on Mar. 15, 2013.

(51) Int. Cl.
*G09F 13/04* (2006.01)
*G09F 13/22* (2006.01)
(Continued)

(52) U.S. Cl.
CPC ..... *G09F 13/0413* (2013.01); *G09F 13/04* (2013.01); *G09F 13/08* (2013.01);
(Continued)

(58) Field of Classification Search
CPC ..... G09F 13/0413; G09F 13/04; G09F 13/08; G09F 13/10; G09F 13/22;
(Continued)

(56) References Cited

U.S. PATENT DOCUMENTS 3,823,443 A 7/1974 Takabayashi ..... 24/186
4,038,726 A 8/1977 Takabayashi ..... 24/169
(Continued)

FOREIGN PATENT DOCUMENTS

DE 102009021194 A1 * 11/2010 ..... F21S 4/20
EP 2365479 9/2011
(Continued)

OTHER PUBLICATIONS

Martin, Light emitting diode strip has flexible and reversible roll-up support, where multiple flexible or rigid conductor plate strips are spaced from one another on roll-up support, Nov. 18, 2010, DE102009021194A1, English.*
(Continued)

*Primary Examiner* — Bryon T Gyllstrom
*Assistant Examiner* — James M Endo
(74) *Attorney, Agent, or Firm* — Ferguson Case Orr Paterson LLP

(57) ABSTRACT

A lighting system having a light box housing, a plurality of lighting units, a plurality of light emitting elements mounted on a PCB. The lighting units can also be interconnected in a daisy-chain configuration on at least one carrier, such that the lighting units form an array of lighting units. The array of lighting units adapted to be mounted within the light box housing, wherein the light box housing has one or more arrays of lighting units.

47 Claims, 12 Drawing Sheets

(51) Int. Cl.

| | |
|---|---|
| ***F21S 2/00*** | (2016.01) |
| ***F21V 21/088*** | (2006.01) |
| ***F21V 21/14*** | (2006.01) |
| ***F21V 23/00*** | (2015.01) |
| ***F21V 17/00*** | (2006.01) |
| ***F21S 4/22*** | (2016.01) |
| ***F21S 4/20*** | (2016.01) |
| ***F21V 21/005*** | (2006.01) |
| ***G09F 13/08*** | (2006.01) |
| ***G09F 13/10*** | (2006.01) |

(52) U.S. Cl.

CPC ..... *G09F 13/10* (2013.01); *G09F 13/22* (2013.01); *F21S 2/005* (2013.01); *F21S 4/20* (2016.01); *F21S 4/22* (2016.01); *F21V 17/007* (2013.01); *F21V 21/005* (2013.01); *F21V 21/088* (2013.01); *F21V 21/14* (2013.01); *F21V 23/001* (2013.01); *G09F 2013/222* (2013.01)

(58) Field of Classification Search

CPC ..... G09F 2013/222; G09F 2013/225; G09F 2013/0477; G09F 2013/0445; G09F 2013/0413; F21S 2/005; F21S 2/00; F21S 4/22; F21S 4/20; F21S 4/28; F21S 4/24; F21S 8/043; F21S 8/068; F21V 21/088; F21V 21/0885; F21V 21/005; F21V 21/14; F21V 21/26; F21V 19/0055; F21V 19/02; F21V 17/007; F21V 23/001; F21V 23/06; F21V 15/013; H05K 9/0043; H05K 9/0055; H05K 9/02; H01R 13/62; H01R 13/621; H01R 13/6272; H01R 4/5066; Y10T 24/4453; Y10T 24/44538; Y10T 24/44299; Y10T 24/44547; F21K 9/17; Y02B 20/386

USPC ..... 40/544; 362/133, 249.15, 249.04, 362/249.03, 249.06, 249.07, 249.08, 362/249.16, 370, 217.12, 249.11, 217.13, 362/217.11, 217.16, 368, 249.01, 219; 428/316.5, 229.13, 229.23, 231.51, 316.1, 428/500, 505, 316.7, 316.6; 24/516, 514, 24/535, 562, 569; 439/725; 248/216.1, 248/295.11, 316.5, 316.4, 227.2, 231.85, 248/231.61, 225.25, 225.11, 231.51, 248/221.11, 221.12, 222.14, 223.36, 248/223.41, 224.7, 300, 301

See application file for complete search history.

(56) References Cited

U.S. PATENT DOCUMENTS 5,452,187 A * 9/1995 Belfer ..... F21V 21/32 362/221
5,622,341 A 4/1997 Stana ..... 248/221.11
5,689,860 A * 11/1997 Matoba ..... F16G 11/00 24/115 F
5,697,175 A 12/1997 Schwartz
5,772,311 A * 6/1998 Williams ..... F21S 2/00 362/152
5,794,897 A * 8/1998 Jobin ..... H02G 7/053 24/459
5,900,850 A * 5/1999 Bailey ..... G09F 9/33 340/815.83
5,941,483 A * 8/1999 Baginski ..... F16L 3/22 248/68.1
5,979,095 A 11/1999 Schneider ..... 24/704.1
6,042,248 A * 3/2000 Hannah ..... G09F 13/0404 362/235
6,362,801 B1 * 3/2002 Yuhara ..... G09F 9/3026 345/82
6,367,179 B1 * 4/2002 Marsh ..... G09F 13/04 313/25
6,418,010 B1 * 7/2002 Sawyer ..... B60R 11/0235 248/918
6,505,956 B1 * 1/2003 Priddy ..... F21V 17/007 362/249.04
6,558,021 B2 * 5/2003 Wu ..... G09F 13/22 340/815.45
6,612,436 B1 * 9/2003 Zullo ..... B65D 51/28 206/391
6,677,918 B2 * 1/2004 Yuhara ..... G09F 9/33 345/1.3
6,685,385 B1 2/2004 Ledingham ..... 403/3
7,013,535 B2 * 3/2006 Tracy ..... A44B 99/00 24/115 H
7,168,197 B2 * 1/2007 Siegenthaler ..... G09F 7/18 160/378
7,712,950 B1 * 5/2010 Addario ..... B60Q 1/305 362/370
7,740,386 B2 * 6/2010 Tsuji ..... F21V 21/002 362/249.02
7,808,386 B1 10/2010 Sayegh ..... 235/385
7,996,963 B2 * 8/2011 Cameron ..... B60P 7/0823 24/344
8,449,145 B1 * 5/2013 Berry ..... F21S 4/00 362/249.02
8,695,290 B1 * 4/2014 Kim ..... F24J 2/5252 248/225.11
2003/0183413 A1 * 10/2003 Kato ..... H02G 3/32 174/135
2003/0213882 A1 * 11/2003 Chen ..... F16M 13/02 248/316.1
2003/0218878 A1 * 11/2003 Swaris ..... F21S 4/20 362/234
2004/0196651 A1 * 10/2004 Newbold ..... F21S 2/00 362/133
2005/0050779 A1 * 3/2005 Tsao ..... G09F 9/33 40/544
2006/0039142 A1 * 2/2006 Temple ..... G09F 9/33 362/231
2006/0072318 A1 * 4/2006 Witham ..... A61L 2/10 362/234
2006/0082987 A1 * 4/2006 Dorsey ..... F21S 48/215 362/103
2006/0114680 A1 * 6/2006 Miller ..... F21S 8/08 362/370
2006/0129103 A1 * 6/2006 Bierman ..... A61M 25/02 604/174
2007/0183147 A1 * 8/2007 Herlands ..... F21V 17/007 362/217.01
2007/0200045 A1 * 8/2007 Ayotte ..... B60Q 7/02 248/505
2007/0283729 A1 * 12/2007 Saitoh ..... E05B 73/0017 70/57.1
2008/0232105 A1 * 9/2008 Saha ..... B29C 45/14065 362/267
2008/0244944 A1 * 10/2008 Nall ..... G09F 13/04 40/544
2008/0304271 A1 * 12/2008 Lei ..... A63H 3/006 362/382
2009/0073693 A1 * 3/2009 Nall ..... G09F 13/04 362/249.02
2009/0121988 A1 * 5/2009 Amo ..... G09G 3/2088 345/82
2009/0146910 A1 * 6/2009 Gardner ..... F21S 2/005 345/1.3
2009/0266958 A1 10/2009 Meersman ..... 248/231.51
2010/0127639 A1 * 5/2010 Cha ..... F21V 15/01 315/294
2010/0238663 A1 * 9/2010 Chen ..... G09F 13/22 362/249.03
2011/0019413 A1 * 1/2011 Zimmerman ..... G09F 13/22 362/249.02

(56) References Cited

U.S. PATENT DOCUMENTS

| | | | | |
|---|---|---|---|---|
| 2011/0096531 | A1* | 4/2011 | Frey | G02F 1/133305 362/97.4 |
| 2011/0134640 | A1* | 6/2011 | Bertele | G09F 9/33 362/249.02 |
| 2011/0226919 | A1* | 9/2011 | Fryzek | F21S 8/026 248/298.1 |
| 2012/0262920 | A1* | 10/2012 | Longardner | F21V 19/008 362/249.01 |
| 2013/0009019 | A1* | 1/2013 | Fukumoto | F16L 3/2235 248/67.5 |
| 2013/0182440 | A1 | 7/2013 | Drew et al. | |
| 2014/0078760 | A1* | 3/2014 | Rossini | B63B 45/02 362/477 |

FOREIGN PATENT DOCUMENTS

| | | |
|---|---|---|
| WO | WO 2012119002 | 9/2012 |
| WO | WO 2012129567 | 9/2012 |

OTHER PUBLICATIONS

Invitation to Pay Additional Fees from PCT/US2014/028569, dated Jul. 15. 2014.
Tandem2 product information from US LED: Tandem by US LED. two pages.
Tetra Powerstrip LED Lighting System by GE Lighting, 4 pages.
International Search Report and Written Opinion from Appl. No. PCT/US2014/068929.

* cited by examiner

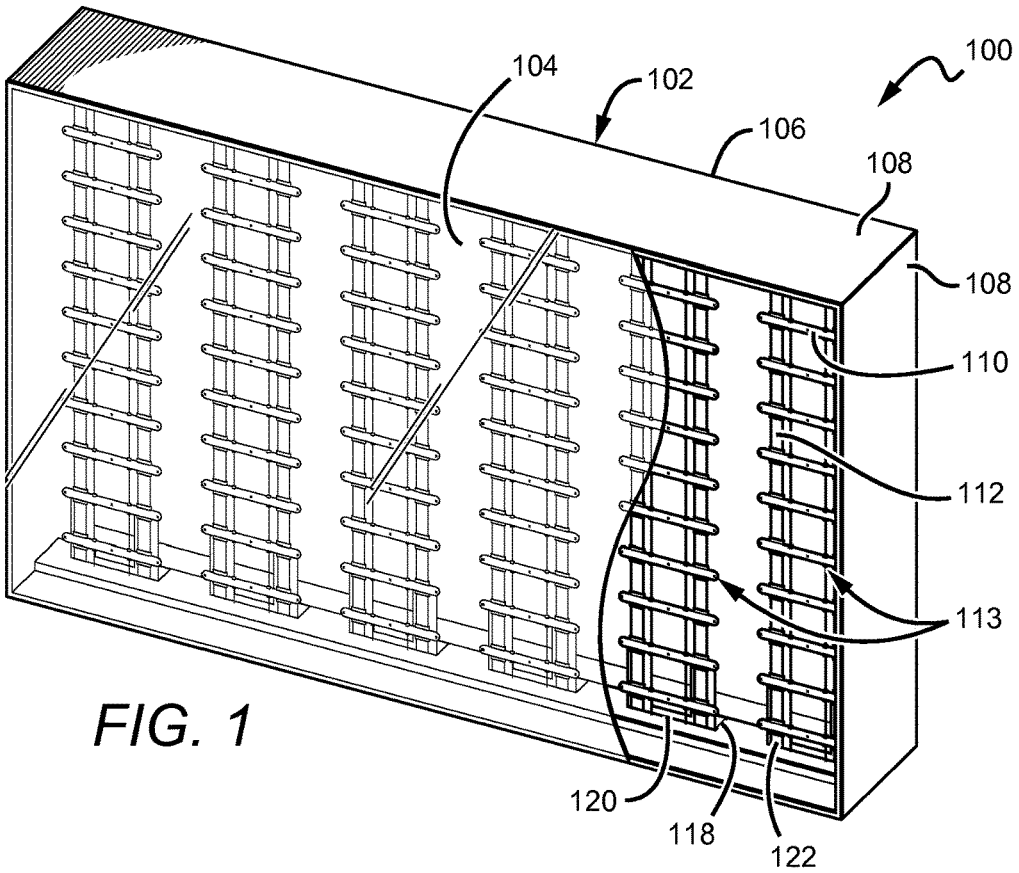
FIG. 1
FIG. 2a
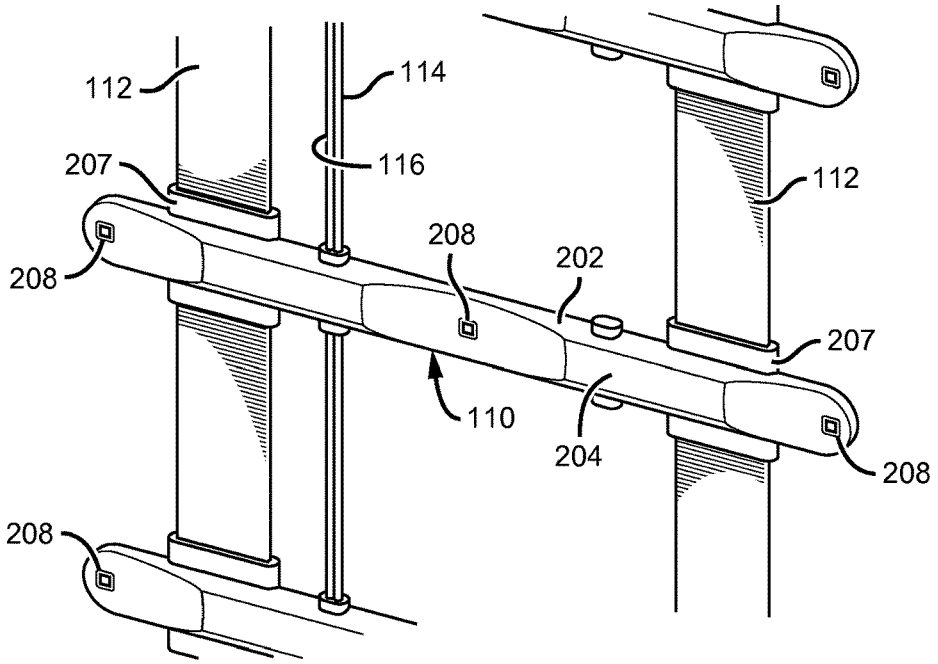

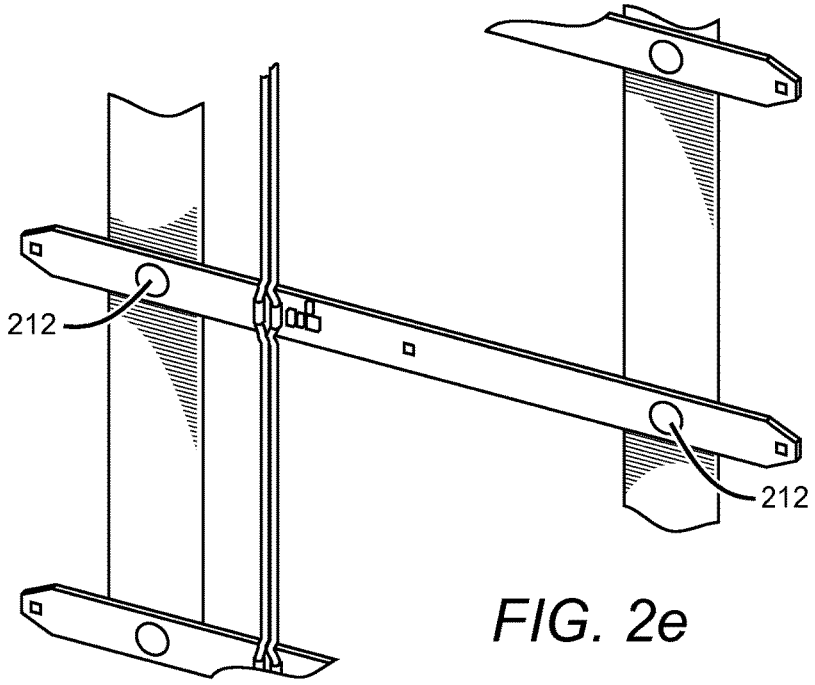
FIG. 2e
FIG. 3a
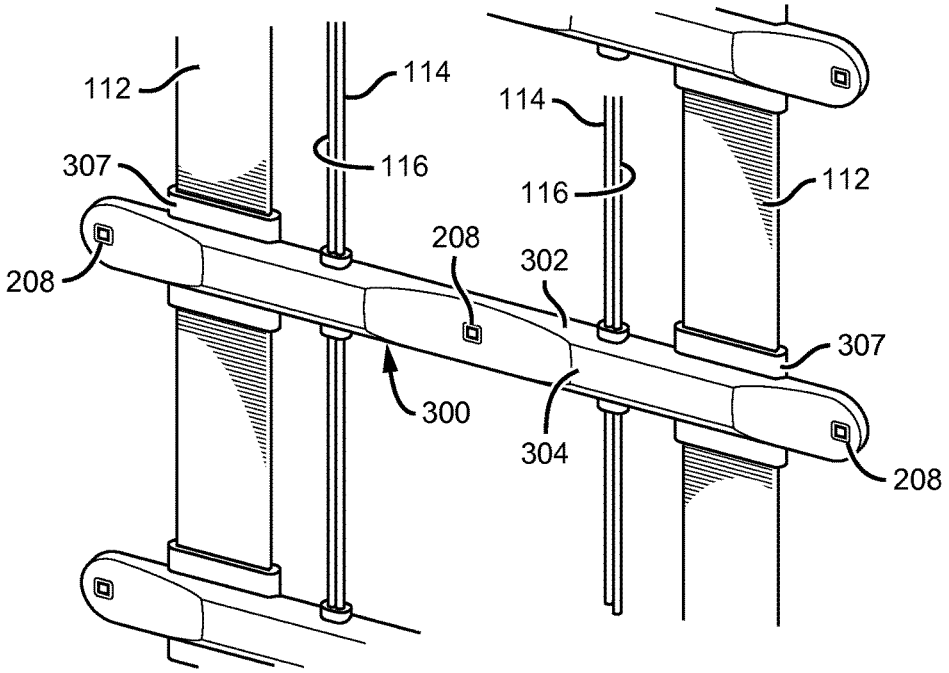

FIG. 5a
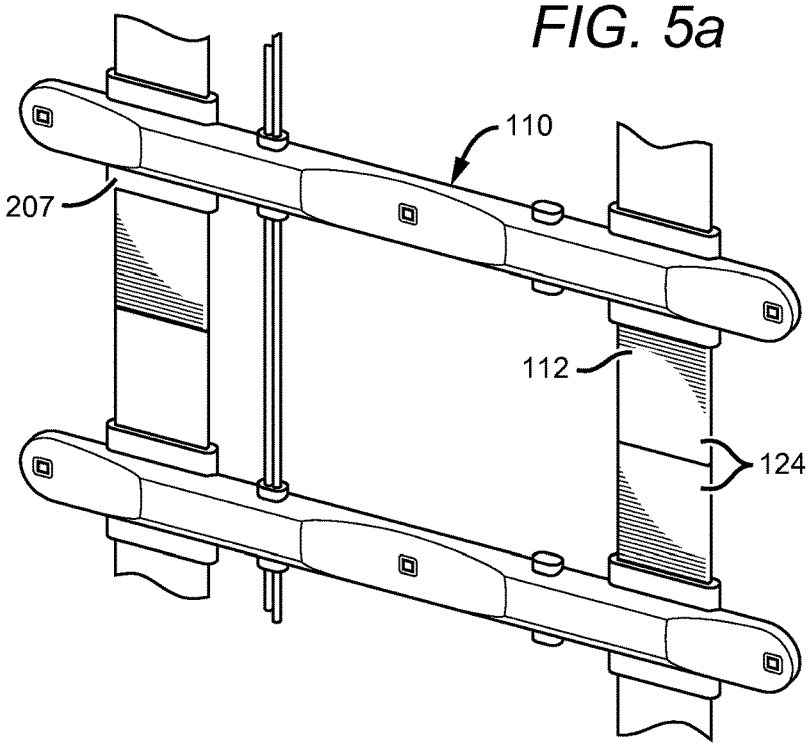
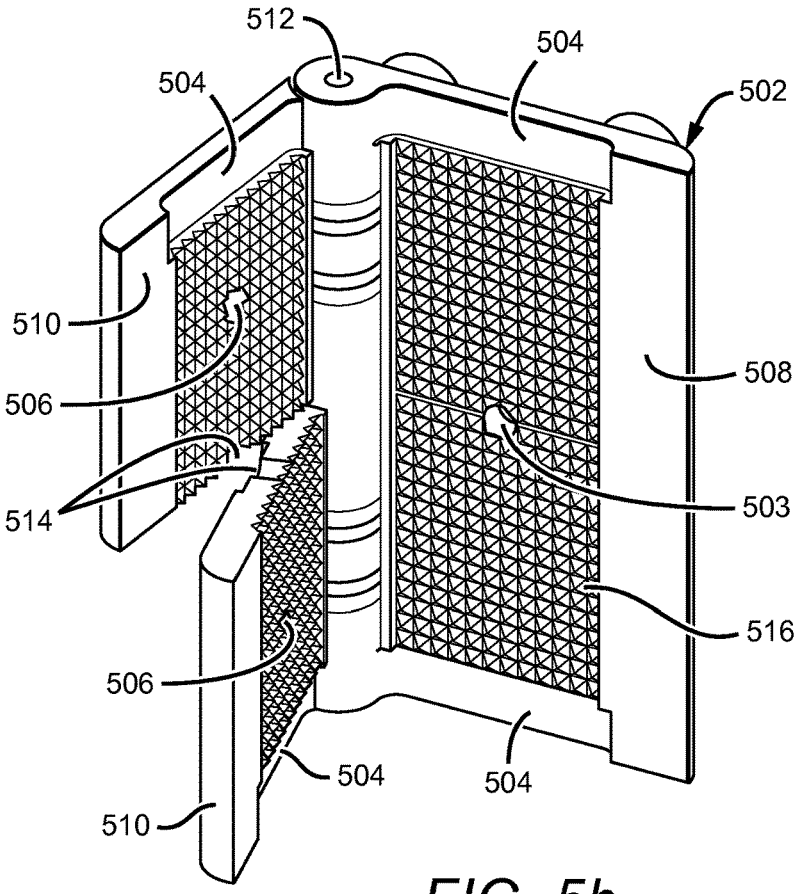
FIG. 5b

SIGN BOX LIGHTING SYSTEM

RELATED APPLICATION

This application claims the benefit of priority of U.S. Provisional Application Ser. No. 61/794,517 to Quaal et al., which was filed on Mar. 15, 2013. U.S. Provisional Application Ser. No. 61/794,517, including its drawings, schematics, diagrams and written description, is hereby incorporated in its entirety by reference.

BACKGROUND OF THE INVENTION

Field of the Invention

This invention relates to lighting units using light sources, such as but not limited to light emitting diodes (LEDs) and more particularly to LED based lighting units for illuminating light boxes or sign cabinet lights.

Description of the Related Art

Display units, such as light boxes, cabinet signs and box signs are commonly found on the outside of buildings or businesses and are often used to advertise the name of the business or products. Typical units are constructed of aluminum or plastic housing having the shape of a box and can range from being approximately 5 inches to many feet deep. The housing sometimes has a swing open frame to allow for easily changing the advertising graphics within. The illuminated face in the housing, or surface, is typically covered by a translucent or clear lens that transmits light from within the housing. The advertisement graphic is placed under this lens so that it is between the lens and the lighting units inside the light box. This allows the graphic to be illuminated from behind by the lighting units within the light box. In some cases the translucent lens itself may be the illuminated graphic.

Some light boxes or sign cabinets have graphics on one side and light only illuminates that side, whereas others are double-faced such that the two opposite sides of the light box each have a translucent or clear lens with a graphic and lighting inside the light box or sign cabinet illuminates both these sides and graphics.

To enhance the visibility of the advertisement within these units, different types of lighting are incorporated. Various types of lighting systems are used with different light sources such as incandescent bulbs, neon bulbs or fluorescent tubes. One of the problems associated with the conventional lighting units and systems is that their light sources can experience relatively short lifespans and they can have relatively low electrical efficiency. Incandescent bulbs, neon bulbs and fluorescent tubes have a relatively short lifespan, particularly when compared to other light sources, such as typical LEDs. These light sources are also electrically inefficient and providing sufficient lighting, especially in large lighting applications, requires the consumption of significant energy. For example, a standard fluorescent tube 60 inches in length consumes as much as 60 to 70 Watts, and conventional display units can utilize many of these tubes. Neon bulbs can also experience difficulty with cold starting, which can lead to failure of the neon bulb.

More recently, with the advent of the efficient solid state lighting sources, these display units have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with a vast majority of the electricity they consume being released as heat rather than light. Fluorescent light bulbs are more energy efficient than incandescent light bulbs, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1,000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours.

The increased efficiency and extended lifetime of LEDs is attractive to many lighting suppliers and has resulted in LED lights being used in place of conventional lighting in different sign applications. For example, U.S. Pat. No. 5,697,175 to Schwartz, discloses a low power illuminated sign that is particularly adapted for use with common EXIT signs over doorways. The back of each sign comprises a reflector with a series of cavities with curved surfaces. Each cavity corresponds to a letter and background area in the sign. LEDs are mounted in the center of the cavities to illuminate the letters or background area. The LEDs are provided on a separate perpendicular circuit board or on a central projection formed in the bottom of the cavities, with light from the LEDS directed outward. The letters and background area of the sign are illuminated by light reflecting forward from the curved surfaces of the cavities, so that the only visible light is from the illumination of the cavities.

LED based light box lighting replacements are available in the marketplace. One such solution comprises a chain of LEDs within a glass tube, mimicking a fluorescent bulb structure. LED based light box lighting is also available from GE Lighting Solutions, East Cleveland, Ohio, under product name Tetra® PowerStrip and Tetra® PowerStrip DS, which comprises overmolded LED lighting modules that each have 3 LEDs. These LEDs are covered by a lens to spread the area of the light outputted. The chain of LED modules is then mounted on a rigid rail or into a rigid tube, each of which is then mounted inside a light box to hold the LEDs in place. In single sided light boxes the light modules can also be mounted directly to the back of the unit.

LED based light box lighting is also available from US LED, Houston, Tex., under product name Tandem2, which comprises pre-assembled 4-foot sections with connector clip and "L-Brackets" for installation. Each light module has several LEDs. The chains of LED modules, in 4-foot sections, are mounted on a rigid rail, each of which is then mounted inside a light box to hold the LEDs in place. In some embodiments these lighting units can be provided as multiple lighting units interconnected by conductors in a chain so that an electrical signal applied to the chain causes the lighting units to emit light. Different lengths of the chain can be utilized for a particular channel letter, with the desired length of chain being cut from the rail and mounted within the light box. Each chain is connected to each other by 24" cables. Power can then be applied to the chain causing the units to emit light. The chains are spaced approximately 9-12" apart within the light box.

Different types of chains can have different numbers of lighting units per a length, or stated differently, a different density of lighting units. These chains are typically sold at a cost per measure of length, and the cost per length is typically greater for lighting systems having higher density. To accommodate the different needs of customers for chains of different densities, many different types of lighting system chains need to be maintained and stored and made available to customers. In some light box applications it may be desirable to have different densities of units in different locations. This can require purchasing multiple chains with different densities for the same job.

Each of the lighting units in the chain also has a certain number of LEDs, such as two, four, eight, sixteen, etc., depending on the embodiment. In certain circumstances it may be desirable to have fewer than all the number of LEDs provided on the units, such as in locations where the illumination should be spread. Conventional lighting units, however, offer little flexibility in reducing the number of LEDs in certain ones or all of the LED units in a chain.

SUMMARY

The invention provides various embodiments of lighting units and systems of manufacturing the same. The invention is configured to be efficient, reliable, cost effective and can be arranged to provide illumination for structural lighting, display lighting and ingress/egress lighting, and is particularly applicable for light boxes or sign cabinet lighting. The different embodiments comprise elements to alter or control the light distribution pattern emitted from the light sources within the lighting unit. The elements can comprise many different materials or devices arranged in different ways, with some devices comprising a plurality of electrically connected lighting units.

In one embodiment, as broadly described herein, a lighting system is disclosed that comprises a light box housing including a front surface and a back surface, a plurality of lighting units, and a mounting mechanism such that the plurality of lighting units are mounted within the light box housing. The plurality of lighting units can be interconnected to form an array of lighting units, such that the array of lighting units is mounted within the light box housing. The lighting system can comprise one or more arrays mounted within the light box housing.

The lighting unit comprises a housing, a plurality of light emitting elements, a printed circuit board (PCB) within the housing wherein the plurality of light emitting elements are mounted on the PCB. The lighting unit further comprises conductors to provide an electrical current to each of the light emitting elements. The light emitting elements are adapted to emit light in a direction away from the housing, in response to the electrical current supplied by the conductors. The lighting units can further comprise a mounting mechanism to mount the lighting units within the light box housing.

These and other aspects and advantages of the invention will become apparent from the following detailed description and the accompanying drawings which illustrate by way of example the features of the invention.

BRIEF DESCRIPTION OF THE DRAWINGS

FIG. 1 is a perspective view of a lighting system according to an embodiment of the invention.

FIG. 2*a* is a perspective view of a lighting unit according to an embodiment of the invention.

FIG. 2*e* is a perspective view of the lighting unit shown in FIG. 2*a*.

FIG. 3*a* is a perspective view of a lighting unit according to an embodiment of the invention.

FIG. 5*a* is a perspective view of a lighting unit according to an embodiment of the invention.

FIG. 5*b* is a perspective view of a coupler according to an embodiment of the invention.

DETAILED DESCRIPTION

Figure 2B:
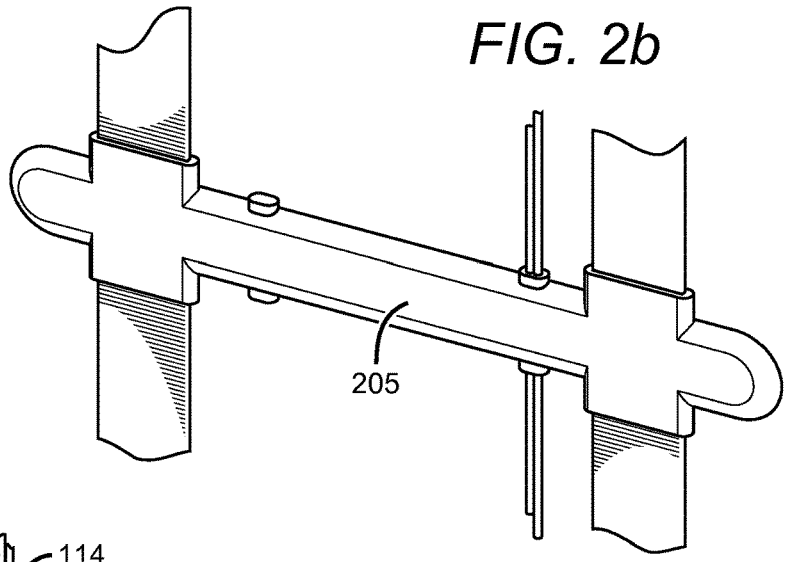
FIG. 2*b* is a rear view of the lighting unit shown in FIG. 2*a*.

The invention described herein is directed to different embodiments of a lighting system that can be used in many different applications such as but not limited to structural lighting, display lighting and ingress/egress lighting. The lighting system according to the invention can be arranged in many different ways with many different components, and is generally arranged to provide illumination for light boxes or sign cabinets. In some embodiments, the lighting system comprises a light box housing and plurality of lighting units, wherein the plurality of lighting units are interconnected in a daisy-chain configuration. Electrical conductors are provided to each of the plurality of lighting units so that an electrical signal applied to the conductors spreads to the lighting units, causing each of the light emitting elements to emit light. The lighting unit can be mounted in various locations within the light box housing. Each of the lighting units comprises a housing including a top side and a bottom side, and a plurality of light emitting elements mounted on a PCB, wherein the PCB is disposed within the housing.

Light boxes and sign cabinet lighting are generally known in the art and are typically used to illuminate an advertisement or signage within the light box or sign cabinet. Conventional light boxes/sign cabinets comprise a housing, a light source, electronic components to power the light source and a transparent cover. Typical light sources for these conventional light boxes/sign cabinets are, for example, incandescent, neon or fluorescent bulbs. Conventional light boxes/sign cabinets can be mounted to a structure, suspended from a ceiling or mounted to a pole, whereas other conventional light boxes/sign cabinets can be recessed into the structure such that the electronic components are within the structure. These light boxes/sign cabinets can be big and bulky due to the physical dimensions of the necessary high power electronic components and the physical size of the light source. As such, the profile of the conventional light boxes/sign cabinets mounted to or recessed in a wall can extend from the wall such that the light box/sign cabinet is not aesthetically pleasing.

The lighting system of the invention can provide a number of additional advantages beyond those mentioned above. For example, in some embodiments the light emitting elements of the lighting units are LEDs, which are physically smaller than fluorescent and incandescent bulbs typically used in the conventional light boxes/sign cabinets, thereby reducing the profile of the lighting system. Additionally, LEDs operate at a lower power level in comparison to fluorescent and incandescent bulbs and do not need similar high power electronic components, leading to smaller electronic components, a reduction in size of the light box housing and overall weight of the lighting system.

The invention is described herein with reference to certain embodiments but it is understood that the invention can be embodied in many different forms and should not be construed as limited to the embodiments set forth herein. In particular, the invention is described with reference to certain embodiments where the light emitting elements are placed within or on a housing, but in other embodiments this configuration can be modified. The invention can also be used with different types of lighting units used in different applications beyond light boxes and sign cabinets, and although the invention is described herein with reference to light emitting diodes (LED or LEDs) other light sources can be used.

It is to be understood that when an element or component is referred to as being "on" another element or component, it can be directly on the other element or intervening elements may also be present. Furthermore, relative terms such as "between", "within", "adjacent", "below", "proximate" and similar terms, may be used herein to describe a relationship of one element or component to another. It is understood that these terms are intended to encompass different orientations of the device in addition to the orientation depicted in the figures.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the invention can be arranged in many different ways with many more features and elements beyond what is shown in the figures.

Embodiments of the invention are described herein with reference to illustrations that are schematic illustrations. As such, the actual thickness of elements and features can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. An element illustrated or described as square or rectangular will typically have rounded or curved features due to normal manufacturing tolerances. Thus, the elements illustrated in the figures are schematic in nature and their shapes are not intended to illustrate the precise shape of a feature of a device and are not intended to limit the scope of the invention.

FIG. 1 shows an embodiment of a lighting system 100 according to the invention. The lighting system 100 comprises a light box housing 102 including a light transmissive face 104, a back 106 opposite the light transmissive face and a plurality of sidewalls 108 separating the light transmissive face 104 and the back 106. The lighting system 100 further comprises a plurality of lighting units 110 within the light box housing 102 on at least one carrier 112, such that the plurality of lighting units 110 on the at least one carrier 112 form an array of lighting units 113. The plurality of lighting units 110 are electrically connected by first and second electrical conductors 114, 116. Each of the lighting units 110 are adapted to emit light in response to an electrical signal. The electrical conductors 114, 116 conduct electricity to the lighting units 110 and an electrical signal applied to the conductors 114, 116 is conducted to each of the lighting units 110 so that the plurality of lighting units 110 simultaneously emit light. The lighting units 110 are arranged such that, when illuminated, give the appearance that the light box housing 102 has a continuous light source.

The light box housing 102 further comprises a mounting mechanism to mount the plurality of lighting units to the light box housing. The mounting mechanism can be comprised of at least one pair of mounting brackets 118 mounted to opposing sidewalls 108 of the light box housing 102. The at least one pair of mounting brackets 118 are adapted to receive an array of lighting units 113. The array of lighting units 113 is received by the at least one pair of mounting brackets 118 by coupling an endpoint 120 of the array to a respective mounting bracket 118. In one embodiment of the invention, the array of lighting units 113 are arranged in a linear array. As such, the pair of mounting bracket 118 are aligned on opposing sidewalls 108 such that the array endpoints 120 can be properly mounted to the pair of mounting bracket 118. Proper alignment of the pair of mounting brackets 118 allows the array of lighting units 113 to be properly positioned within the light box housing 102, which allows the light emitted from the array of lighting units to be evenly emitted out the light transmissive face 104.

The endpoints 120 of the array 113 are received by a clamp 122, wherein the clamp 122 is coupled to a respective end 124 of the at least one carrier 112. The carrier 112 and clamp 122 combination are coupled to one of the pair of mounting brackets 118 in order to mount the array of lighting units 113 within the light box housing 102. In the embodiment of FIG. 1, the array of lighting units 113 is comprised of a plurality of lighting units 110 on two carriers 112, wherein each carrier 112 is received by a respective clamp 122 at a respective end 124 of each carrier 112. The ends 124 and clamps 122 are then coupled to the pair of mounting brackets 118, whereby the array of lighting units 113 is mounted within the light box housing 102. The light box housing 102 can comprise a plurality of arrays 113 mounted within the light box housing. However, in other embodiments, the light box housing 102 can be arranged to comprise at least one array of lighting units 113. The array 113 can be configured in many different ways and is not intended to be limited to the embodiments discussed herein. In other embodiments, the array can be arranged to comprise one carrier 112 or more than two carriers 112. In yet other embodiments, the array can be arranged in a non-linear array, such as but not limited to curved, bent or the like.

The light box housing 102 can be configured such that the light transmissive face 104 includes a transparent, translucent, or graphic covered cover. The light transmissive face can be formed of many different materials, such as but not limited to, plastic, tempered glass or the like. In embodiments where the light transmissive face 104 comprises a translucent or graphics covered cover, the light emitted from the lighting units 110 can be diffused by either the features of the lighting units or the translucent or graphics cover, so as to give the appearance that the lighting system 100 has a continuous light source.

Each of the lighting units can comprise a plurality of light emitting elements 208. The light emitting elements may be arranged in many different ways. The lighting units 110 can have any number of light emitting elements, but the examples shown herein have either 3 or 6 light emitting elements. The light emitting elements 208 emit light out from the lighting unit 110 in response to an electrical signal. The electrical conductors 114, 116 conduct electricity to the lighting units 110 and an electrical signal applied to the conductors 114, 116 is conducted to each of the lighting units 110 so that the light emitting elements 208 on each of the lighting units simultaneously emit light. The lighting units 110 are particularly adapted to being mounted in the light box housing 102 or sign cabinet lighting, wherein the light transmissive face 104 of the light box housing 102 is the light emitting surface of the lighting system 100. In some embodiments, the lighting system 100 is configured to be mounted on a wall or similar structure, such that substantially all light is emitted out the light transmissive face 104 of the light box housing 102. In other embodiments, the lighting system 100 can be recessed mounted into a wall or similar structure, while in other embodiments the lighting system 100 can be mounted to a pole or other stand-alone structures.

FIGS. 2*a*-2*e* disclose an embodiment of the lighting units 110 according to the invention, and disclose additional components or features that may be included in the lighting system 100. For the same or similar elements or features, the same reference numbers will be used throughout the application herein. The lighting units 110 comprise a housing 202 having a front surface 204 and a back surface 205, a plurality of light emitting elements 208, a PCB 206 within the housing 202, wherein the plurality of light emitting elements 208 are mounted on the PCB 206 and are exposed through the housing 202. The PCB 206 can be made of many different materials, such as but not limited to a flexible material, rigid material, or any other suitable PCB material. The PCB 206 also comprises at least one slot 210 arranged to receive a fastener 212 to couple the PCB to the at least one carrier 112. The PCB 206 can be arranged to be substantially planar such that the PCB provides a substantially planar surface to receive each of the plurality of light emitting elements 208. However, in other embodiments, the PCB 206 can be arranged to provide at least one angled surface to receive at least one of the plurality of light emitting elements 208. The plurality of light emitting elements 208 can be arranged in a linear configuration on the PCB 206, such that the light emitting elements 208 are separated from adjacent light emitting elements by the same or different distance. The light emitting elements 208 can be arranged in many different configurations on the PCB 206 and is not intended to be limited to a linear configuration.

Figure 2C:
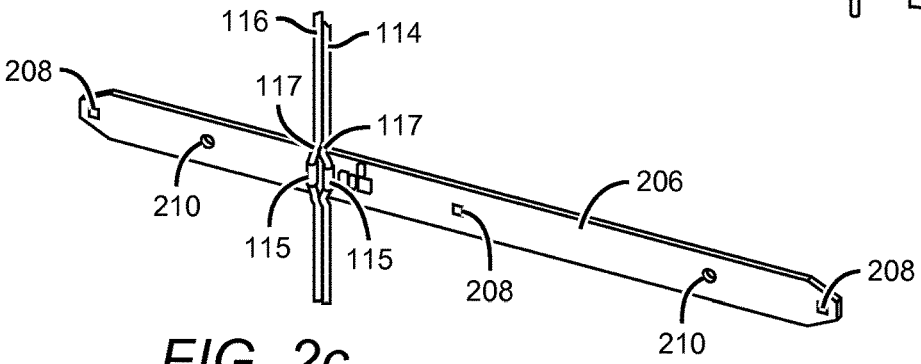
FIG. 2*c* is a perspective view of the lighting unit shown in FIG. 2*a*.

The lighting units 110 further comprise conductors 114, 116 in electrical connection with the PCB 206. As shown in FIG. 2*c*, the PCB 206 comprises crimp terminals 115 configured to receive each of the conductors 114, 116. The conductors 114, 116 are arranged to be a continuous length of conductors and are center-stripped such that the outer insulation of each conductor 114, 116 is removed, leaving part the center conductor 117 of each conductor 114, 116 exposed. The center conductor 117 of each conductor 114, 116 is received by a respective crimp terminal 115, whereby a force is applied to the crimp terminals 115 such that the crimp terminals are compressed tightly around the exposed center conductor 117 of each conductor 114, 116. The crimp terminals 115 can be soldered onto the PCB 206 using a reliable reflow, wave soldering or other solder processes known in the art. The crimp terminals 115 can be coupled to the PCB 206 using a number of different methods known in the art and is not intended to be limited to the embodiments disclosed herein.

An advantage of the invention is that the conductors 114, 116 can be center-stripped at regular intervals, which provides a continuous length of conductors 114, 116 with exposed center conductors 117 of controlled lengths at regular intervals. Center-stripping the conductors 114, 116 at controlled regular intervals allows the PCB 206 to be separated from adjacent PCBs 206 by a spacing corresponding to the controlled regular intervals. This eases the construction and spacing of the lighting units 110 because the exposed center conductors 117 of the conductors 114, 116 provide a visual indication as to where the PCBs 206 are to be connected to the conductors 114, 116. Using center-stripped conductors 114, 116 also eliminates the need of having to cut and strip numerous conductors, especially when connecting a plurality of PCBs into a daisy chain configuration to form an array of lighting units. The center-stripped conductors significantly reduces the amount of time needed to connect numerous PCBs when forming a long array of lighting units, as well as reducing costs related to manufacturing.

Yet another advantage of using center-stripped conductors is that the exposed center conductors 117 provides a large surface area of exposed center conductor to make positive, reliable contact to the crimp terminals on the PCBs. The crimp terminals 115 when crimped or compressed onto the center conductors 117 firmly holds the conductors 114, 116 in place preventing the center conductor 117 from being released from crimp terminals, which can also provide structural support to the PCB and the lighting units. The conductors 114, 116 being continuous and not cut when connected to the crimp terminals makes pulling the conductors out of the crimp terminal 115 more difficult than if the conductors were cut and crimped in the crimp terminal 115.

The conductors 114, 116 can be electrically connected to the PCB 206 using many different methods, and the invention is not intended to be limited to the embodiments disclosed herein. In other embodiments, the conductors 114, 116 can be electrically connected to the PCB by soldering. In yet other embodiments, Insulation Displacement connectors (IDC) or Insulation Piercing connectors (IPC) can be used to electrically connect the conductors to the PCB 206.

In one embodiment, the conductors 114, 116 can be on the same surface of the PCB 206 as the light emitting elements 208. However, in other embodiments, the conductors can be on either side of the PCB 206. The conductors 114, 116 electrically couple the electrical signal on the conductors 114, 116 to their respective one of the lighting units 110. The PCB 206 can also comprise conductive traces (not shown) to conduct electrical signals from the conductors 114, 116 to the light emitting elements 208 so that an electrical signal applied to the conductors is conducted to the light emitting elements through the traces, causing the light emitting elements to emit light.

The light emitting elements 208 are generally mounted along a longitudinal axis of the PCB 206, although they can also be mounted in other locations. In the embodiment of FIGS. 2*a*-2*e* the lighting unit 110 comprises three light emitting elements 208. The invention is not intended to be limited to only having three light emitting elements. In other embodiments, the lighting units can comprise more or less than three lighting elements, such as but not limited four, six, and eight or more, that can be mounted in many different locations. The light emitting elements 208 can be any device that emits light in response to an electrical signal, such as but not limited to incandescent lights, lasers, laser diodes, fluorescent light, neon lights, or light emitting diodes (LEDs). The light emitting elements 208 can be an LED arranged to emit different colors of different intensities, with a suitable LED being commercially available emitting high luminous flux white light. One suitable LED would output 150 lumens per watt, however other LEDs have an output that is higher or lower.

In some embodiments, the lighting unit 110 can comprise an optical element proximate each of the light emitting elements. The optical element can be in the form of a lens over each of the light emitting elements, a diffuser proximate the light emitting elements, or a reflector proximate the light emitting elements, or a combination thereof. In yet other embodiments, the optical element may be a separate structure or part of the housing 202. In one embodiment, the optical element can, be arranged to diffuse the light emitted from light emitting elements 208 so that the light emitted from the lighting unit has an even light distribution pattern. In some embodiments, the optical element can be arranged to have light altering properties such that the light emitted from the lighting unit 110 is redirected in order to produce a desired light distribution pattern, such as but not limited to a uniform light distribution pattern or a directional light distribution pattern. The optical element can be a separately formed structure that is mounted onto the lighting unit 110 proximate the light emitting elements 208. The optical element can be mounted onto the lighting unit using a variety of methods, such as but not limited to glued onto the lighting unit or mechanically fastened (screws, nails, rivets or the like). In yet other embodiments, the optical element can be overmolded onto the lighting unit.

Figure 2D:
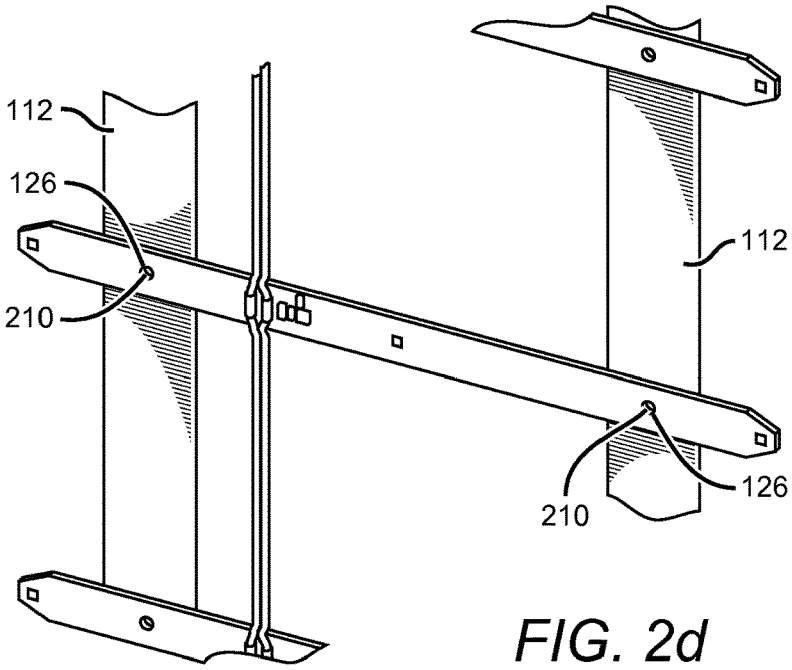
FIG. 2*d* is a perspective view of the lighting unit shown in FIG. 2*a*.

As shown in FIG. 2*c*, the PCB 206 further comprises two slots 210. The slots 210 are arranged to receive a respective fastener 212 in order to couple the PCB to a respective carrier 112. The carrier 112 comprises a plurality of carrier holes 126 that are adapted to receive the respective fastener 212 to couple the PCB 206 to the carrier 112. With reference to FIG. 2*d*, each of the carriers 112 comprise a plurality of linearly aligned carrier holes 126 that are separated from adjacent carrier holes by an equal distance. In order to couple the PCB 206 to the respective carrier 112, the PCB 206 is positioned on each carrier 112 such that the slots 210 of the PCB are aligned with a respective carrier hole 126 of each carrier 112. As shown in FIG. 2*e*, upon the alignment of the slots 210 and the carrier holes 126, a respective fastener 212 can be inserted into the slot and carrier hole, thereby coupling the PCB 206 to each of the two carriers. The fastener 212 can be any type of fastening device, such as but not limited to a button, bolt, clamp, dowel, screw, nail, pin, rivet or the like.

An advantage of the invention is that the carrier holes being separated by an equal distance allows the PCB 206 to be separated from adjacent PCBs by a similar distance, which in turn results in the lighting units 110 being separated from adjacent lighting units 110 by an equal distance. Another advantage is that the plurality of lighting units 110 mounted on the carriers 112 forms an array of lighting units 113 wherein each of the plurality of lighting units are substantially aligned, which results in the light emitting elements 208 of each lighting unit 110 being substantially aligned. As such, the light emitted from the array 113 has a consistent light radiation pattern and does not vary from the lighting units 110 on the carriers 112. In one embodiment, each of the lighting units 110 of the array 113 are arranged to be substantially perpendicular to the carrier 112. However, in other embodiments, the lighting units can be arranged in a number of different ways, with respect to the carrier, and is not intended to be limited to being substantially perpendicular.

With reference back to FIGS. 2*a*-2*b*, once the PCB 206 is mounted to the carriers, a housing 202 is placed on the PCB 206. In the embodiment of FIGS. 2*a*-2*b*, the housing 202 is an overmold housing that is overmolded onto the PCB 206 and part of the conductors 114, 116 and part of the carriers 112 that are adjacent the PCB 206. The housing 202 overmolded onto part of the carrier 112 adjacent the PCB 206 forms a shoe 207 that covers part of the carrier 112. The shoe 207 extends outward from the housing 202 and can be arranged to couple the housing 202 to the carrier 112. An advantage of the invention is that the overmolded housing 202 coupled to the carriers 112 provides support to ensure that the PCB 206 remains coupled to the carriers 112. In the event that the fastener 212 were to fail, the overmolded housing 202 would be able to provide support to maintain the positioning of the PCB 206 on the carrier 112. In the embodiment of FIGS. 2*a*-2*b*, each lighting units 110 comprises four shoes 207, two shoes 207 are formed at the area where the PCB 206 is coupled to the carrier 112. Since there are two carriers 112 used in the embodiments of FIGS. 2*a*-2*b* each lighting unit 110 comprises four shoes 207. However, the invention is not intended to be limited to four shoes. In other embodiments, the lighting units can comprise more or less than four shoes. The number of shoes formed could be based on many different factors, such as but not limited to the number of carriers used or the overmold used to form the housing. In other embodiments, the housing can be comprised of a plurality of prefabricated parts that are assembled together to form the housing. In such embodiment, the assembled housing can be bonded to at least one of the PCB 206 and/or the carriers 112 in order to secure the assembled housing to at least one of the PCB and/or the carriers 112. The housing can be arranged in many different configurations and is not intended to be limited to the embodiments disclosed herein.

The embodiment of the lighting unit shown in FIGS. 2*a*-2*e* is configured to have a single-sided orientation, such that the light emitting elements 208 are on the same side of the lighting unit 110. The embodiment of the lighting unit 300 shown in FIGS. 3*a*-3*e* is configured to have a double-sided orientation, such that the light emitting elements 208 are on both sides of the lighting unit 300. The single-sided oriented lighting unit 110 is configured to be used in the lighting system 100, wherein the light transmissive face 104 is the only light emitting surface of the light box housing 102. The double-sided oriented lighting unit 300 is configured to be used in a similar light box housing as the single-sided oriented lighting unit 110, but can also be used in a double-sided light box housing wherein both the light transmissive face 104 and the back 106 are configured to be light emitting surfaces. In such embodiment, both the light transmissive face 104 and the back 106 can comprise a transparent, translucent or graphic cover.

The lighting units 300 comprise a housing 302 having a front surface 304 and a back surface 305, a plurality of light emitting elements 208, a PCB 306 within the housing 302, wherein the plurality of light emitting elements 208 are mounted on the PCB 306 and are exposed through the housing 302. The PCB 306 can be made of many different materials, such as but not limited to a flexible material, rigid material, or any other suitable PCB material. The PCB 306 also comprises at least one slot 210 arranged to receive a fastener 212 to couple the PCB to the at least one carrier 112. The PCB 306 can be arranged to be substantially planar such that the PCB provides a substantially planar surface to receive each of the plurality of light emitting elements 208. However, in other embodiments, the PCB 306 can be arranged to provide at least one angled surface to receive at least one of the plurality of light emitting elements 208. The plurality of light emitting elements 208 can be arranged in a linear configuration on the PCB 306, such that the light emitting elements 208 are separated from adjacent light emitting elements by the same or different distance. The light emitting elements 208 can be arranged in many different configurations on the PCB 306 and is not intended to be limited to a linear configuration.

Figure 3B:
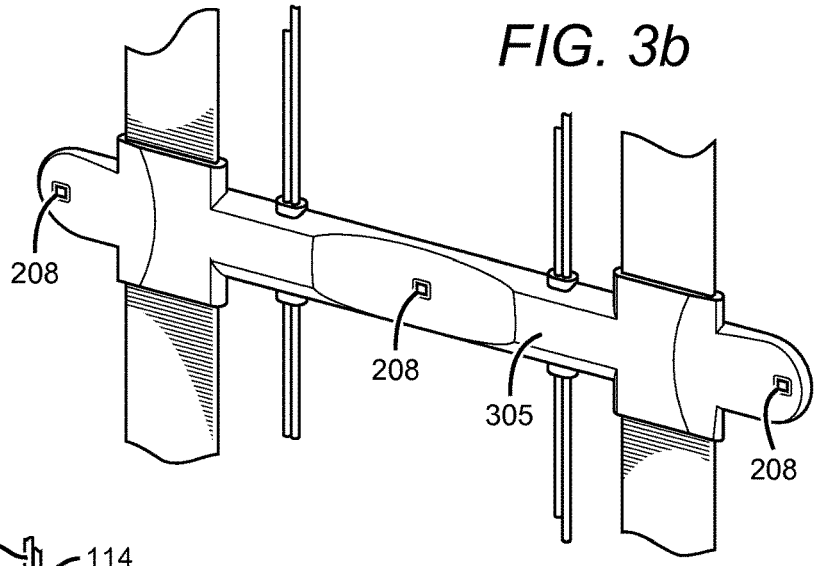
FIG. 3*b* is a rear view of a lighting unit shown in FIG. 3*a*.
Figure 3C:
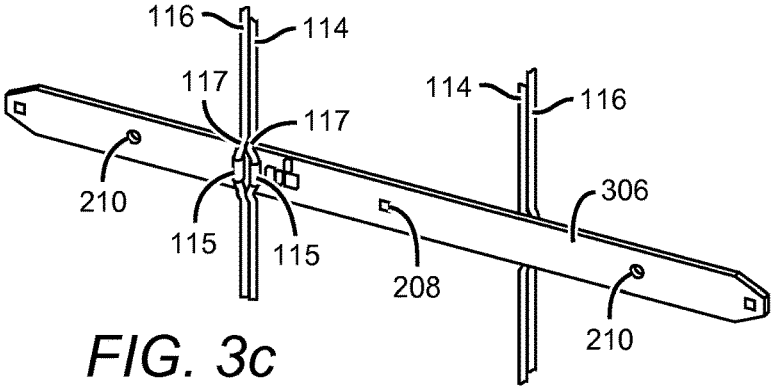
FIG. 3*c* is a perspective view of a lighting unit shown in FIG. 3*a*.

The lighting units 300 further comprise a pair of conductors 114, 116 in electrical connection with the PCB 306. The conductors 114, 116 can be a continuous length of center-stripped conductors exposing the center conductor 117 and electrically connected to the PCB 306 using crimp terminals 115, similarly as discussed above for lighting unit 110. The conductors 114, 116 of the embodiment of FIG. 3*c* are disclosed as being on opposite sides of the PCB 306 and provide an electrical signal to the light emitting elements 208 on the same side. However, in other embodiments, the pair of conductors can be on the same side or different side and still provide an electrical signal to the light emitting elements. In yet other embodiments, the conductors can be on the side of the PCB 306 opposite the light emitting elements 208 such that the conductors provide the electrical signal to the light emitting elements 208 on the other side of the PCB 306.

The conductors 114, 116 electrically couple the electrical signal on the conductors 114, 116 to their respective one of the lighting units 110. The PCB 306 can also comprise conductive traces (not shown) to conduct electrical signals from the conductors 114, 116 to the light emitting elements 208 so that an electrical signal applied to the conductors is conducted to the light emitting elements through the traces, causing the light emitting elements to emit light.

The light emitting elements 208 are generally mounted along a longitudinal axis of the PCB 306 such that the light emitting elements on one side of the PCB are aligned with the light emitting elements on the other side of the PCB. This results in the lighting unit 300 having a light radiation pattern that is the same for both sides of the lighting unit. However, in other embodiments, the light emitting elements 208 on one side of the PCB 306 can be arranged on the PCB in a different arrangement than the light emitting elements on the other side of the PCB. An advantage of this configuration is that the lighting unit can have a different light radiation pattern for each side of the lighting unit, which could be tailored for different lighting solutions.

The lighting unit 300 comprises six light emitting elements 208, with three on each side of the PCB 306. However, the invention is not intended to be limited to only have six light emitting elements. In other embodiments, the lighting units can have any number of light emitting elements on each side. In some embodiments, the number of light emitting elements on both sides of the PCB is the same, while in other embodiments each side of the PCB has a different amount of light emitting elements. The lighting unit 300 can also be configured to have at least one optical element, as discussed above.

Figure 3D:
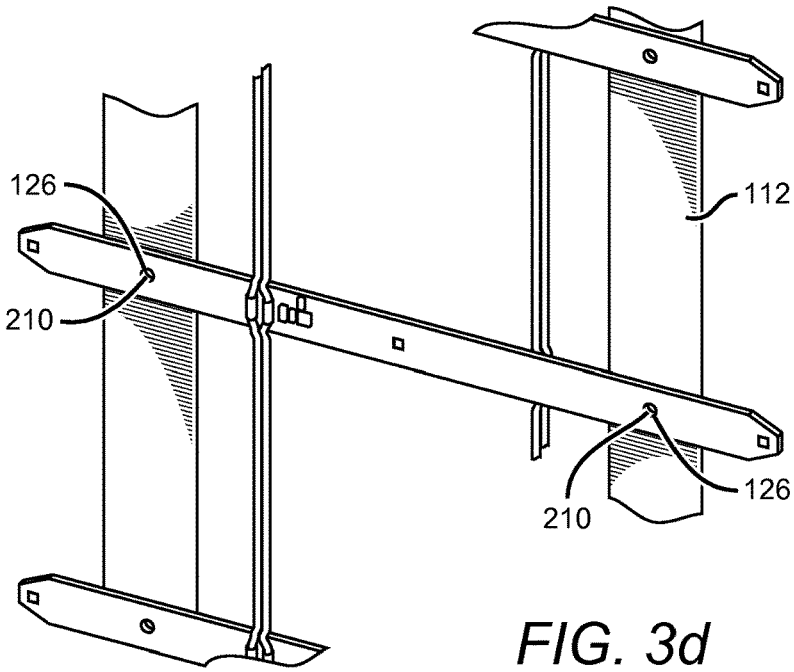
FIG. 3*d* is a perspective view of a lighting unit shown in FIG. 3*a*.
Figure 3E:
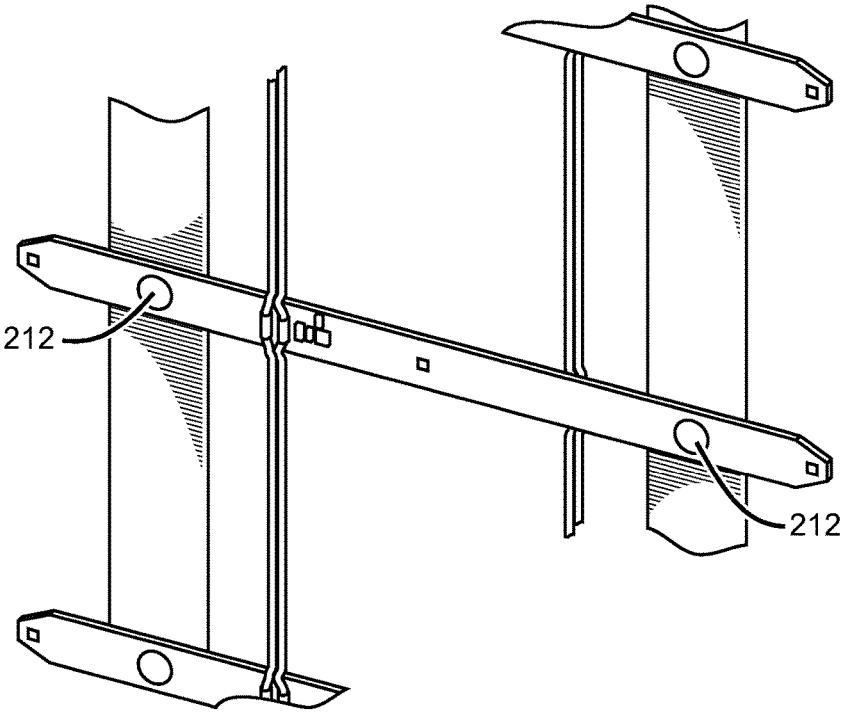
FIG. 3*e* is a perspective view of a lighting unit shown in FIG. 3*a*.

With reference to FIGS. 3*c*-3*e*, the PCB 306 further comprises two slots 210 arranged to receive a respective fastener 212 to couple the PCB to a respective carrier 112. The carrier 112 used with lighting unit 110 can also be used in conjunction with lighting unit 300. Each carrier 112 comprises a plurality of carrier holes 126 adapted to receive a respective fastener 212 to couple the PCB 306 to the carrier. The PCB 306 is coupled to the carrier 112 similarly as PCB 206 is mounted to the carrier 112. The slots 210 of the PCB 306 are aligned with a carrier hole 126 of a respective carrier 112 and a fastener 212 is inserted into the slot 210 and carrier hole 126 which couples the PCB to the respective carrier 112.

Referring back to FIGS. 3*a*-3*b*, once the PCB 306 is mounted to the carriers 112, a housing 302 is placed on the PCB 306. The housing 302 can be an overmold housing that is overmolded onto the PCB 306 and part of the conductors 114, 116 and part of the carriers 112 that are adjacent the PCB 306. The housing 302 overmolded onto part of the carrier 112 adjacent the PCB 306 forms a shoe 307 that covers part of the carrier 112, similar to the shoe 207 of lighting unit 110. The shoe 307 extends outward from the housing 302 and can be arranged to couple the housing 302 to the carrier 112. An advantage of the invention is that the overmolded housing 302 coupled to the carriers 112 provides support to ensure that the PCB 306 remains coupled to the carriers 112. In the event that the fastener 212 were to fail, the overmolded housing 302 would be able to provide support to maintain the positioning of the PCB 306 on the carrier 112. In the embodiment of FIGS. 3*a*-3*b*, each lighting units 300 comprises four shoes 307, two shoes formed at the area where the PCB 306 is coupled to the carrier 112. Since there are two carriers 112 used in the embodiments of FIGS. 3*a*-3*b* each lighting unit 300 comprises four shoes 307. However, the invention is not intended to be limited to four shoes. In other embodiments, the lighting units can comprise more or less than four shoes. The number of shoes formed could be based on many different factors, such as but not limited to the number of carriers used or the overmold used to form the housing.

The carrier 112 can be arranged in many different configurations. For example, the carrier can comprise a plurality of carrier holes 126, wherein the spacing between adjacent carrier holes is varied. This would allow a lighting unit to be mounted in different arrangements based on the configuration of the light box housing or the lighting solution. For example, the light box housing 102 of FIG. 1 has a rectangular shape with a plurality of linearly aligned arrays of lighting units 113; a carrier having holes whose spacing between adjacent carrier holes 126 is varied would allow the lighting units to be mounted on the carriers in non-linear or non-aligned configurations which could accommodate for irregularly shaped or custom shaped light box housings. In yet other embodiments, the carrier 112 can be arranged to comprise a plurality of linearly aligned carrier holes 126 that are spaced close together such that the spacing between adjacent lighting units 110 can be altered. Allowing the spacing between adjacent lighting units 110 to be adjusted provides flexibility in being able to control or adjust the light distribution pattern of the lighting units for a given lighting solution. This also allows for adjusting lighting units in the event that a hot spot or dark spot is present. In yet further embodiments, the carrier does not have any carrier holes 126, wherein a carrier hole can be formed at any location along the carrier or the fastener used to couple the PCB to the carrier is adapted to pierce the carrier when coupling the PCB to the carrier.

The carrier 112 can be formed of many different materials, such as but not limited to cotton, nylon, polyester, polypropylene or the like or a combination thereof. In some embodiments, the carrier can be a webbing formed of strong fabric woven as a flat strip or tube of varying width and fibers. In some embodiments, the carrier can be a multi-paneled webbing, similarly configured as automotive seat belts. An advantage of the invention is that the carrier provides a light weight and heavy duty material to receive the lighting units. Also, the carrier reduces costs related to manufacturing, shipping and installation. The carrier is flexible and pliable, such that the carrier can bend freely or repeatedly without breaking. The carrier can be bent in many different directions and does not become deformed or broken due to being bent. The carrier can be bent, twisted and/or folded and still be able to return to its original state, such as but not limited to a flat strip. The carrier is strong and durable such that the carrier can withstand the weight of the lighting units coupled to the carrier, thereby providing structural support to the lighting units mounted onto the carrier. Furthermore, the carrier can be mounted within a light box housing such that the carrier is taut and maintains the positioning of the lighting units within the light box housing.

Figure 4A:
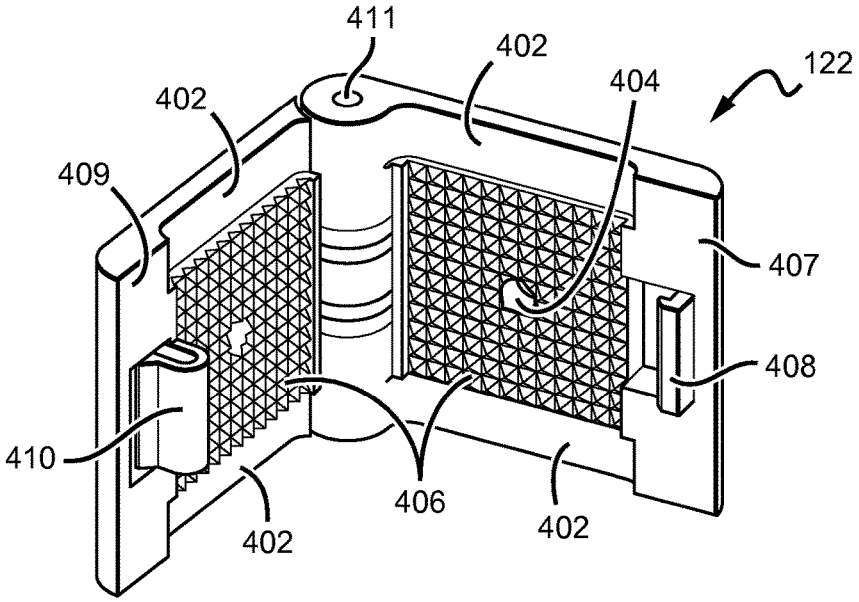
FIG. 4*a* is a perspective view of a clamp according to an embodiment of the invention.

FIGS. 4*a*-4*g* disclose how the array of lighting units can be mounted within the light box housing. FIG. 4*a* discloses a clamp 122 adapted to be coupled to an endpoint 120 of the array 113. The clamp 122 comprises a front plate 409, a back plate 407 and a hinge 411, wherein the front plate is hingedly connected to the back plate. The front plate is adapted to be received by the back plate such that the back plate holds the front plate and prevents the front plate from disengaging the back plate. In this arrangement, the clamp 122 could be considered as being closed. The back plate comprises a stop 408 extending from the back plate and the front plate comprises a tongue 410 extending from the front plate. The stop 408 is arranged to receive the tongue 410 when the front plate 409 is rotated about the hinge 411 and positioned adjacent the back plate 407. As the front plate 409 is positioned adjacent the back plate 407, the tongue 410 is slightly bent by the stop 408 as the stop receives the tongue. The front plate is received by the back plate when the tongue 410 has been fully received by the stop 408, such that the front plate is no longer able to be rotated about the hinge 411. The tongue 410 can be disengaged from the stop 408 by applying a force onto the tongue slightly bending the tongue and releasing the tongue from the stop 408.

The front and back plate further comprise at least one recess 402, at least one aperture 404, and a plurality of projections 406. The at least one recess 402 of the front and back plate are arranged to form a pocket 414 when the front plate is received by the back plate, or when the clamp 122 is closed. The pocket 414 is adapted to receive a shoe 207 of the lighting unit 110, to assist in holding the lighting unit. The at least one aperture 404 of the front and back plate are arranged to form a channel 412 when the front plate is received by the back plate, which is when the clamp is closed. The channel 412 is adapted to receive a bolt 424 in order to mount the array to the light box housing 102. The plurality of projections 406 can be arranged to have pointed tips, whereby the carrier 112 is placed on the clamp 122 and the clamp is closed, securing the carrier within the clamp. In such embodiment, the pointed tips of the front and back plate are arranged to contact the carrier 112 and hold the carrier in place. The pointed tips can be arranged to pierce the carrier 112 to further secure the carrier within the clamp 122. Furthermore, when the clamp 122 is closed, the clamp can apply a compression force onto the carrier 112 to further hold the carrier within the clamp. The invention is not intended to be limited to the plurality of projections comprising pointed tips, in other embodiments, the plurality of projections can be arranged to comprise a roughened surface or the like.

Figure 4B:
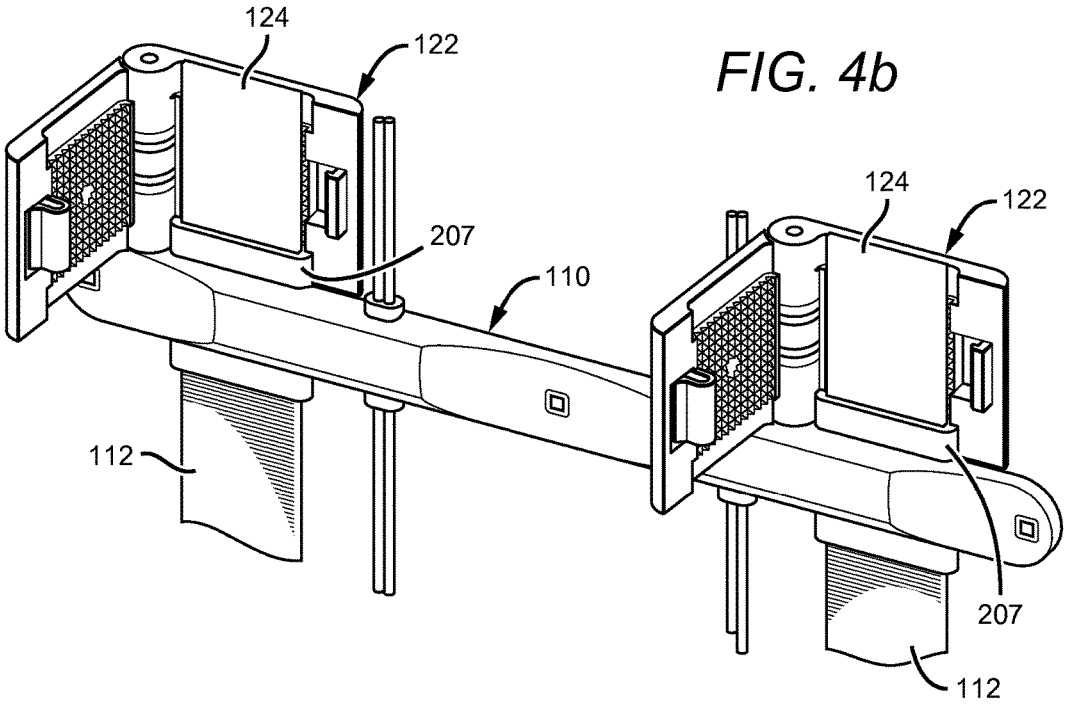
FIG. 4*b* is a perspective view of the clamp shown in FIG. 4*a*.
Figure 4C:
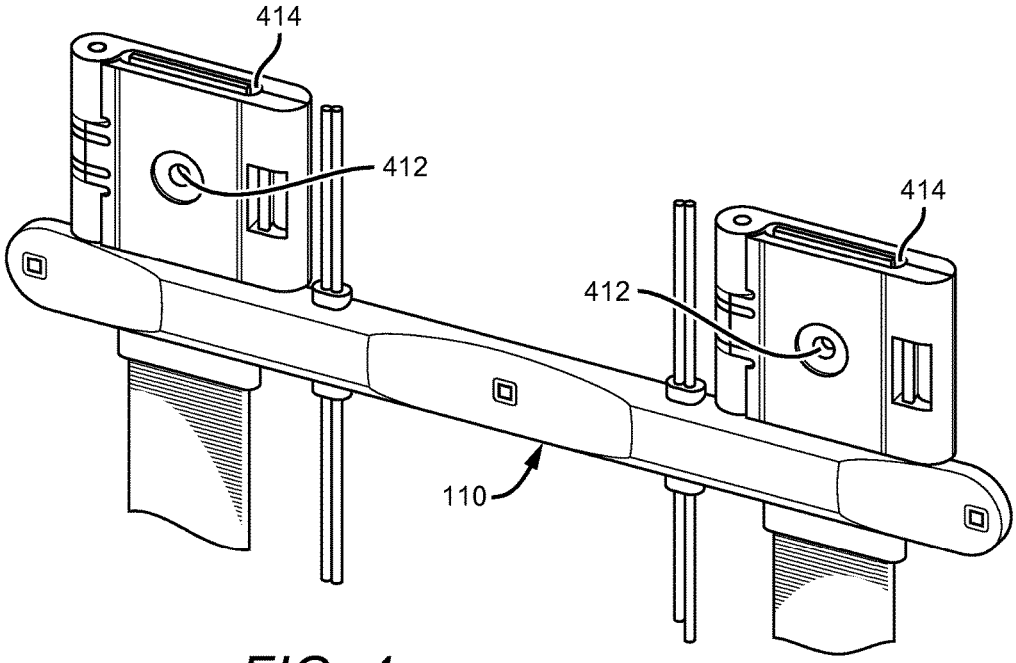
FIG. 4*c* is a perspective view of the clamp shown in FIG. 4*a*.
Figure 4D:
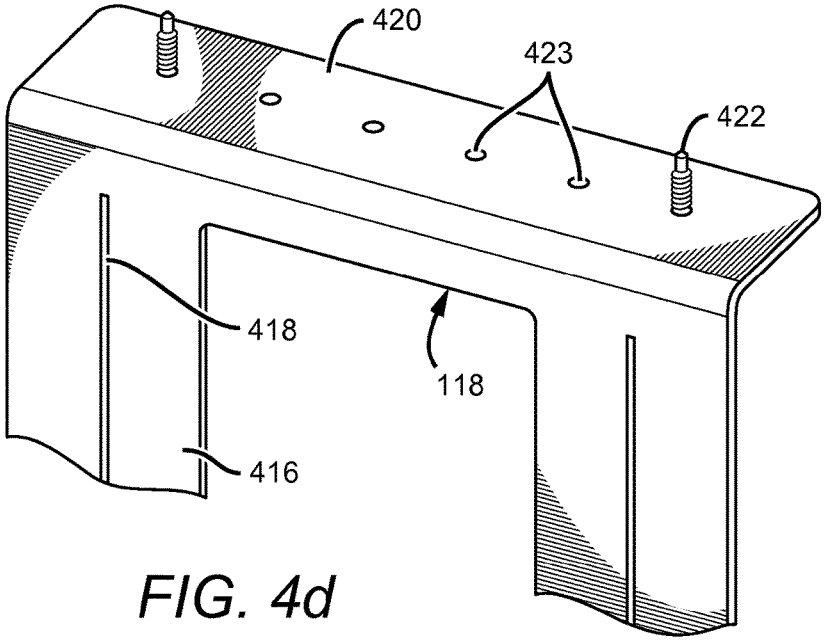
FIG. 4*d* is a perspective view of a mounting bracket according to an embodiment of the invention.

With reference to FIG. 4*b*, a respective end 124 of the carrier 112 is placed within a respective clamp 122, such that the shoe 207 of lighting unit 110 is placed within the recess 402 of the back plate 407. When the shoe 207 is properly seated within the recess 402, the clamp 122 can be closed, as seen in FIG. 4*c*. When the clamp 122 is closed, the recess 402 of the front plate 409 also receives the shoe 207, thereby forming a pocket 414 on opposing ends of the clamp, which is adapted to hold the shoe 207. In one embodiment, the pocket 414 applies a force onto the shoe 207 to assist in holding the lighting unit 110. With the clamp 122 closed, the apertures 404 of the front and back plate form the channel 412, which allows the array to be mounted to the light box housing. The light box housing 102 can comprise a mounting bracket 118 that is mounted within the light box housing and adapted to receive the array 113.

With reference to FIGS. 4*d*-4*g*, the mounting bracket 118 comprises a base 420 and at least one leg 416 extending from the base. The base 420 is arranged to be mounted to a sidewall 108 of the light box housing 102. The mounting bracket 118 can be mounted to the light box housing 102 by using screws, nails, pins, rivets or the like. The mounting bracket can be mounted to the light box housing a number of different means and is not intended to be limited to the embodiments disclosed herein. A pair of mounting brackets 118 are mounted onto opposing sidewalls 108 of the light box housing 102 and are aligned with each other in order to receive the array of lighting units 113. The mounting bracket 118 further comprises a perforation 418 on the leg 416. The perforation 418 is arranged to receive the bolt 424 in order to mount the clamp 122 to the mounting bracket 118. In one embodiment, the perforation 418 extends along part of the leg 416, such that the clamp 122 can be mounted to the mounting bracket 118 anywhere along the perforation. In other embodiments, the leg 416 comprises a plurality of perforations 418 wherein the clamp 122 can be mounted to the mounting bracket at points where one of the plurality of perforations is present. In the embodiment of FIGS. 4*d*-4*g*, the mounting bracket 118 comprises two legs 416. However, the invention is not intended to be limited to the mounting bracket having two legs. The mounting bracket can have one or more legs and can have one or more perforations. The mounting bracket can be arranged to comprise a leg for each carrier of the array, or can comprise only one leg adapted to receive any number of carriers used to form the array of lighting units.

Figure 4E:
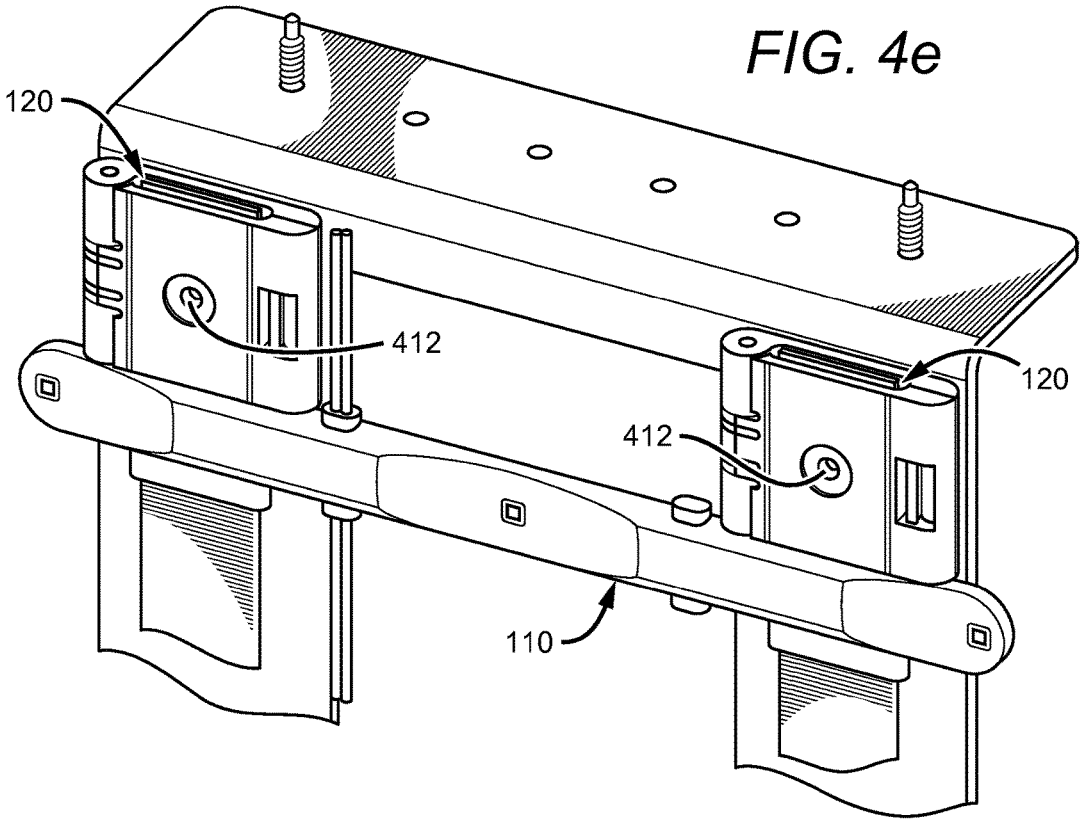
FIG. 4*e* is a perspective view of the clamp shown in FIG. 4*a* and the mounting bracket shown in FIG. 4*d*.
Figure 4F:
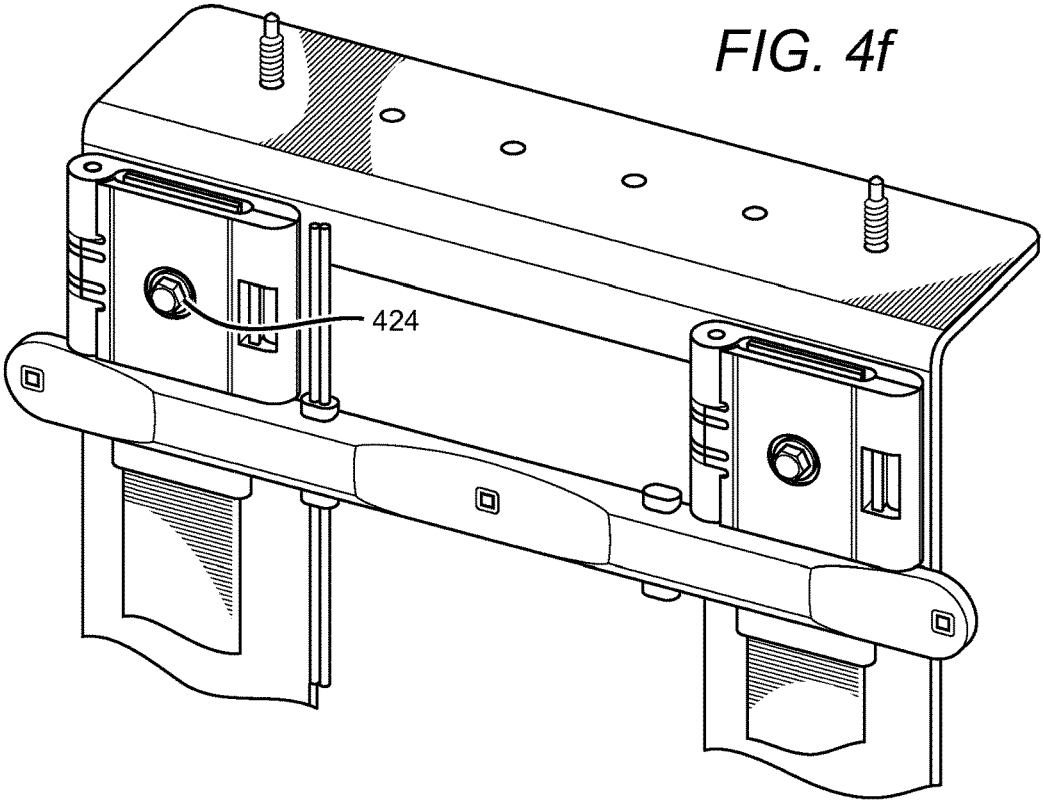
FIG. 4*f* is a perspective view of the clamp shown in FIG. 4*a* and the mounting bracket shown in FIG. 4*d*.
Figure 4G:
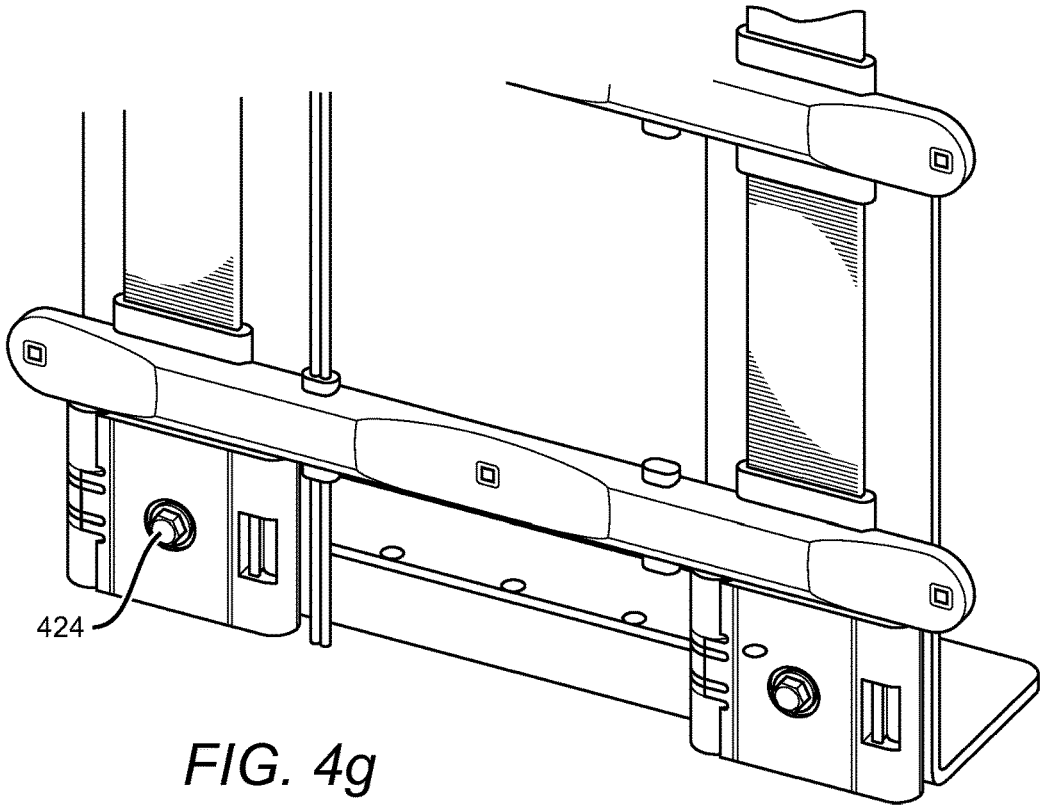
FIG. 4*g* is a perspective view of the clamp shown in FIG. 4*a* and the mounting bracket shown in FIG. 4*d*.

As seen in FIG. 4*e*, the endpoints 120 of the array are positioned on the mounting bracket 118 in order to mount the array to the light box housing 102. The ends 124 of the carrier 112 and the closed clamps 122 are placed on a respective leg 416 of the mounting bracket 118. Each channel 412 of the clamp 122 is aligned with a respective perforation 418 of each leg 416. The bolt 424 is then received by the channel 412 and the perforation 418 coupling each respective end 124 and clamp 122 to a respective leg 416 of the mounting bracket 118, as seen in FIG. 4*f*. FIG. 4*g* shows the other endpoint 120 of the array mounted to the opposing mounting bracket 118. Both endpoints 120 of the array are mounted in a similar manner. The perforation 418 is arranged to properly mount the array of lighting units 113 on the opposing brackets 118, due to the perforation being aligned with the channel 412 of each clamp 122. The perforation aligned with the channel ensures that the array is not misaligned. The bracket 118 does not affect the light emitted from the array of lighting units.

In the embodiment of FIGS. 4*a*-4*g*, the array of lighting units 113 is comprised of lighting units 110, which are arranged to have light emitting elements 208 on only one side. In other embodiments, an array of lighting units comprised of the lighting units 300 can also be mounted to the light box housing similarly as described in FIGS. 4*a*-4*g*. Figures directed to embodiments of mounting an array comprised of lighting units 300 are not included herein in an effort to reduce multiplicity of duplicate figures.

Figure 5C:
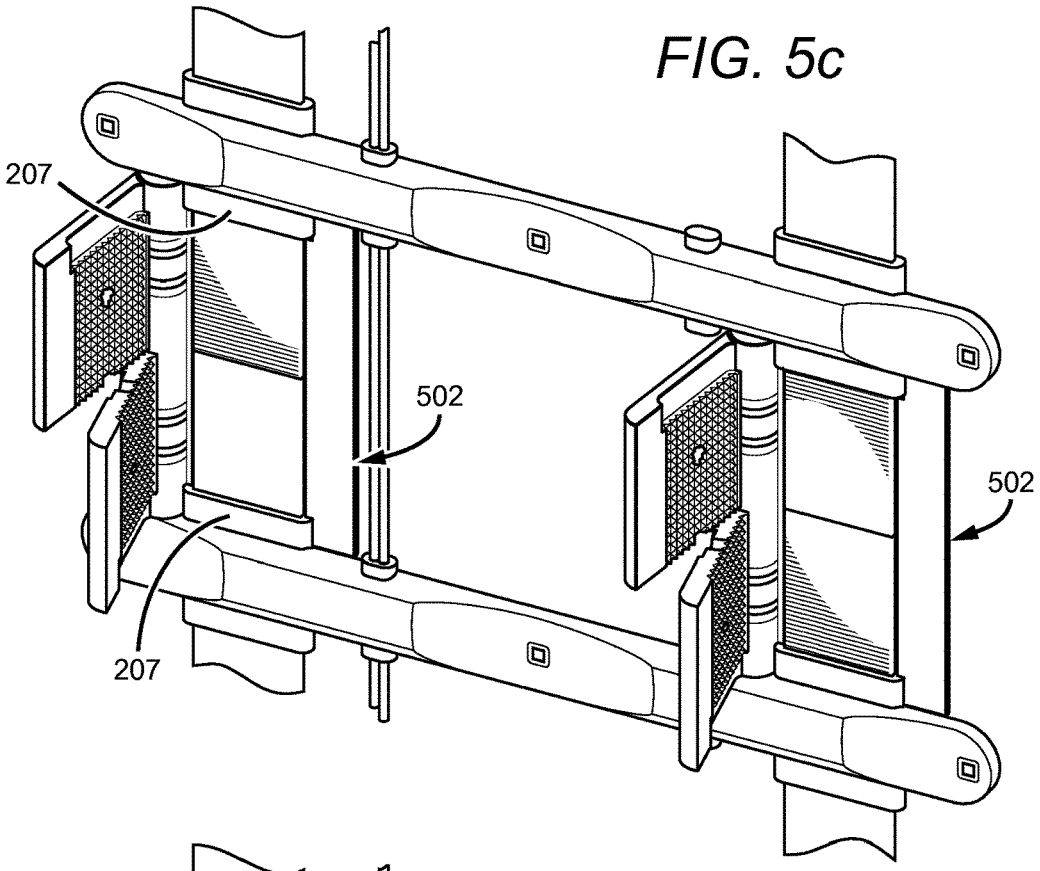
FIG. 5*c* is a perspective view of the lighting unit shown in FIG. 5*a* and the coupler shown in FIG. 5*b*.

FIGS. 5*a*-5*e* disclose an embodiment of the invention wherein a carrier 112 is coupled to another carrier 112. As seen in FIG. 5*a*, the respective ends 124 of the carrier 112 are aligned. In some embodiments, at least one carrier 112 may need to be trimmed in order to be aligned with the other end 124 of the other carrier 112. FIG. 5*b* discloses a coupler 502 that is adapted to couple the two ends 124 of the two carriers 112. The coupler 502 is configured somewhat similar to the clamp 122. However, the coupler 502 comprises a back plate 508, a plurality of front plates 510 and a hinge 512, wherein each of the plurality of front plates are hingedly connected to the back plate. The front and back plates further comprise at least one recess 504, and a plurality of projections 516. The at least one recess 504 of the front and back plates are arranged to form a pocket (not shown), similar to pocket 414, when the front plates are positioned to be adjacent the back plate 508, which is when the coupler 502 is closed. The pocket is adapted to receive the shoe 207, 307 which can assist in holding the lighting unit. Each of the front plates comprise an aperture 506 arranged to receive a pin 517 in order to assist in holding the carrier within the coupler 502. The plurality of projections 516, similarly arranged to projections 406, can be arranged to have pointed tips, whereby the carrier 112 is placed on the coupler 502 and the coupler is closed, securing the carrier within the coupler. In such embodiment, the pointed tips of the front and back plates are arranged to contact the carrier 112 and hold the carrier in place. The pointed tips can be arranged to pierce the carrier 112 to further secure the carrier within the coupler 502. Furthermore, when the coupler 502 is closed, the coupler can apply a compression force onto the carrier 112 to further hold the carrier within the coupler. The invention is not intended to be limited to the plurality of projections comprising pointed tips, in other embodiments, the plurality of projections can be arranged to comprise a roughened surface or the like.

Figure 5D:
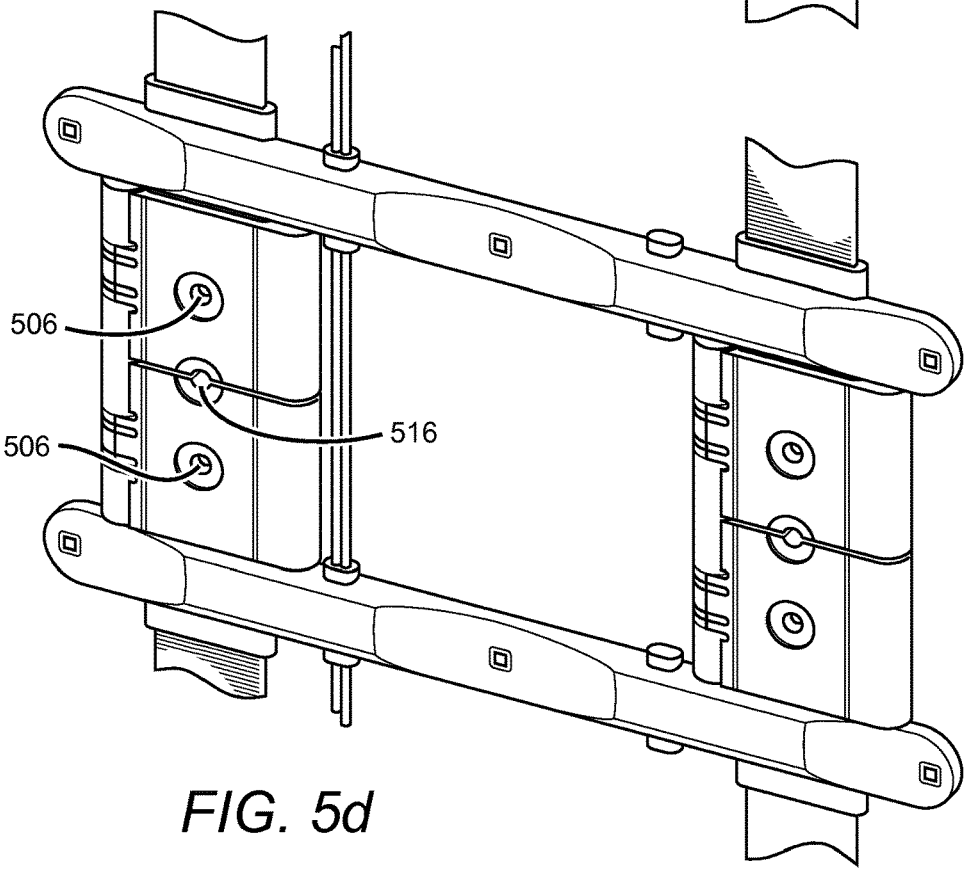
FIG. 5*d* is a perspective view of the lighting unit shown in FIG. 5*a* and the coupler shown in FIG. 5*b*.
Figure 5E:
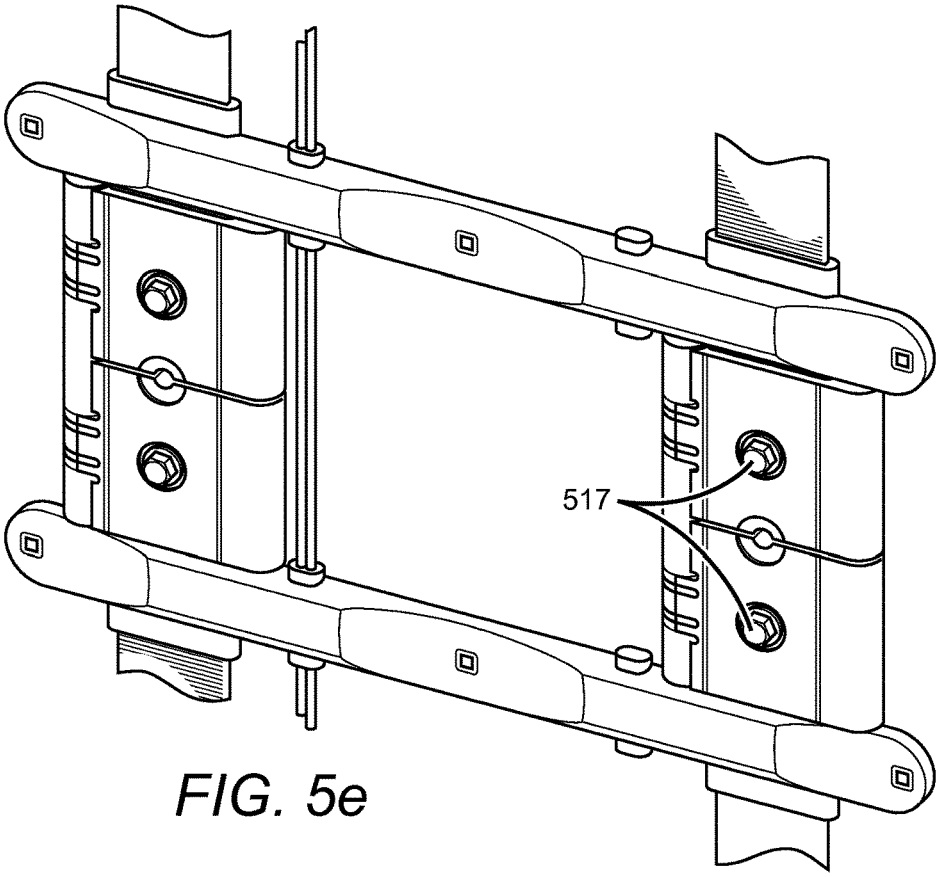
FIG. 5*e* is a perspective view of the lighting unit shown in FIG. 5*a* and the coupler shown in FIG. 5*b*.

With reference to FIG. 5*c*, the respective ends 124 of the carriers 112 are placed within a respective coupler 502, such that the shoe 207, 307 of the lighting unit 110, 300 is placed within the recess 504 of the back plate 508. When the shoe 207, 307 is properly seated within the recess 504, the coupler 502 can be closed, as seen in FIG. 5*d*. When the coupler 502 is closed, the recess 504 of the front plates 510 also receive the shoe 207, 307, thereby forming a pocket (not shown) which holds the shoe 207, 307. In one embodiment, the pocket applies a force onto the shoe to assist in holding the lighting unit. With the coupler 502 closed, the apertures 506 of the front plates 510 are arranged to receive a pin 517. The pin 517 applies a force onto the ends 124 of the carriers 112 in order to couple the carriers 112 to the coupler 502. The pin 517 also applies a force onto a respective front plate 510, such that the front plate applies a compression force onto the carriers 112 to further hold the carrier within the coupler 502. In some embodiments, the pin 517 can be arranged to pierce the carrier 112 to couple it to the coupler, while in other embodiments, the pin 517 does not pierce the carrier but applies a force onto the carrier to couple the carrier to the coupler.

The coupler 502 can be arranged in many configurations and is not intended to be limited to the embodiments disclosed herein. In one embodiment, each of the front plates can further comprise an indentation 514 and the back plate can further comprise an opening 503, such that the indentations and opening are arranged to form a groove 516 when the coupler 502 is closed. The groove 516 is adapted to receive a bolt 424 (not shown) in order to mount the coupler 502 to a light box housing or similar structure. In yet other embodiments, the back plate can comprise an aperture 506 aligned with a respective aperture 506 of each of the front plates 510, such that the apertures 506 of the front plates 510 and the back plate 508 form a channel when the coupler 502 is closed. The channel is adapted to receive a bolt 424, wherein the bolt is arranged to pierce the carrier 112 and be received by the aperture of the back plate 508. In yet other embodiments, the ends 124 of the carriers 112 can be arranged to comprise a hole arranged with the channel to receive the bolt 424 in order to couple the carriers to the coupler.

Lighting units according to the present invention can also comprise other elements, with one embodiment comprising heat sinks to dissipate heat from the light emitting elements. In another embodiment, the lighting units can comprise a power supply (not shown) electrically connected to conductors 114, 116. Power supplies are generally known in the art and are only discussed briefly herein. In one embodiment, the power supply is adapted to provide a constant current output. The power supply provides substantially the same drive current to the light emitting elements 208 so that the lighting unit can emit a substantially constant light distribution pattern in accordance with the desired light emission. In some embodiments, the power supply can be installed remote to the lighting unit, whereas in other embodiments, the power supply can be mounted on or within the light box housing. At least one advantage of the invention is that the power supply, while in operation, allows the plurality of lighting units to provide and maintain the desired light output and prevents the lighting system from exhibiting an undesirable light output, such as but not limited to different levels of light brightness, color variations or variations in the light distribution pattern. In yet other embodiments, the lighting unit can comprise constant current drive circuitry electrically connected to the power supply in order to provide the same drive current to the light emitting elements.

The array of lighting units may be mounted proximate to the back 106 of the light box housing or in between the light transmissive face and back 104, 106 of the light box housing 102 when the light box housing has output surfaces on both of the face and back. The array of lighting units can be installed in existing light box housings as a retrofit kit unit such that the array of lighting units replaces conventional light sources. An advantage of the mounting bracket 118 is that the mounting bracket can be positioned over existing light bulb sockets of existing light box housings which allows the positioning of the array of lighting units to correspond with the position of the replaced conventional light.

Mounting bracket 118 can be made of any suitable material including plastics or metals. In one embodiment, mounting bracket 110 can be attached by any of the above mentioned mounting methods including tape, screws, or nails through mounting holes 423. Mounting bracket 110 may be mounted to the sidewalls 108 of a light box housing or to the back 106 of a light box housing.

In double sided light box housings, which outputs light on both sides of the light box housing, 2 arrays of lighting units 110 may be mounted back-to-back by any of the methods discussed above. In another embodiment wherein the double sided light box housing is used, an array of double-sided lighting units 300 can be used instead of mounting 2 arrays of lighting units 110 in a back-to-back configuration.

Figure 6A:
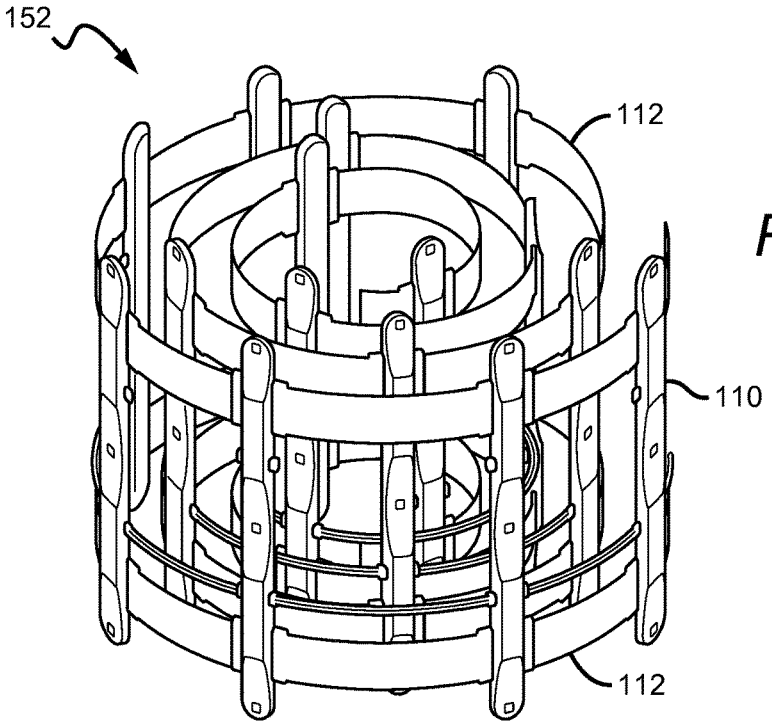
FIG. 6*a* is a perspective view of an array of lighting units according to an embodiment of the invention.
Figure 6B:
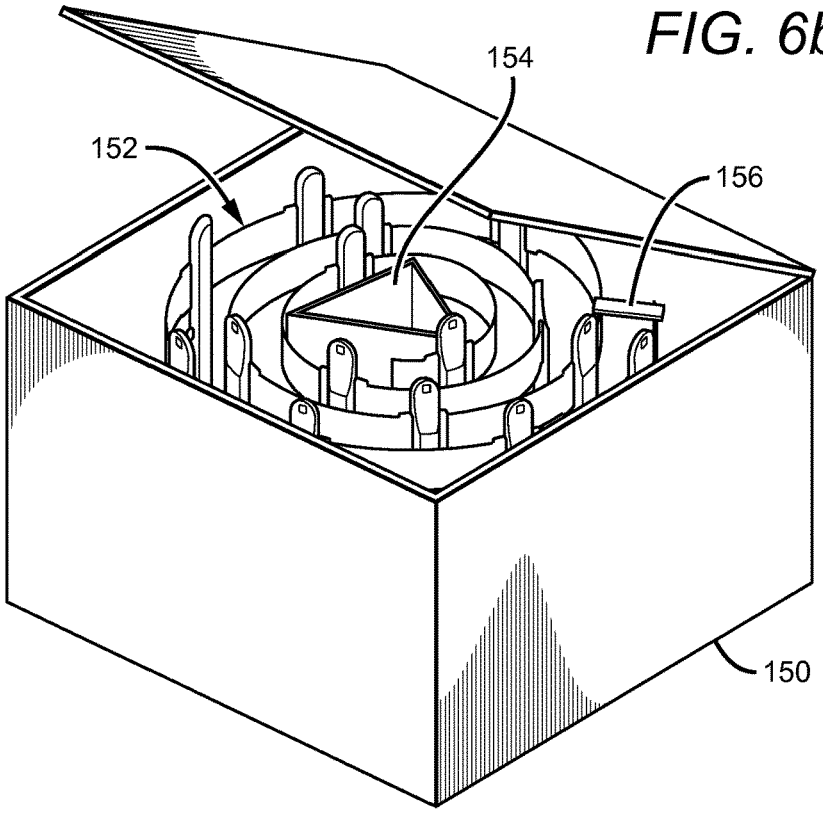
FIG. 6*b* is a perspective view of an array of lighting units according to an embodiment of the invention.
Figure 7:
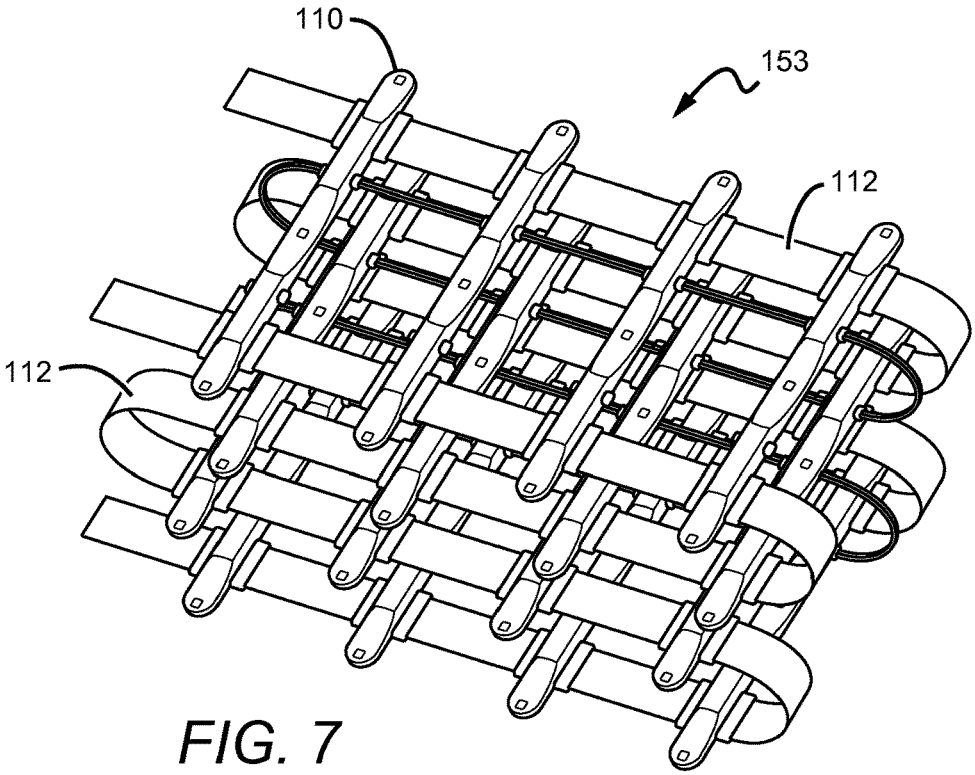
FIG. 7 is a perspective view of an array of lighting units according to an embodiment of the invention.

At least one advantage of mounting the lighting units on the carrier 112 is that the carrier 112 is arranged such that the lighting units mounted on the carrier can be stored in a folded or rolled configuration, thereby making it easy to ship and/or store an extended length of lighting units mounted on the carrier. For example, in one embodiment as shown in FIG. 6, a plurality of lighting units 110 are mounted on two carriers 112, wherein each carrier is a flexible carrier and formed of flexible material, such as but not limited to a webbing. The flexible carrier 112 is configured to allow the plurality of lighting units and the flexible carrier to be rolled into a spiral coil forming a coiled array of lighting units 152. The coiled array of lighting units 152 provides an extended length of fully assembled and electrically connected array of lighting units 152 that are ready to be installed out of the box. In the embodiment of FIG. 6, the coiled array 152 is comprised of lighting units 110. However, the coiled array 152 can also be comprised of lighting units 300. The coiled array 152 also comprises the conductors 114, 116 but are not shown in FIG. 6 for ease of illustration. The coiled array of lighting units allows for ease of installation of the lighting units and eliminates the need for an installer to fully assemble an array of electrically connected lighting units mounted onto a carrier of a desired length. The lighting units of the coiled array of lighting units 152 can also comprise the optical element discussed above. In another embodiment, as shown in FIG. 7, a plurality of lighting units 110 are mounted on two carriers 112, wherein each carrier is a flexible carrier and formed of flexible material, such as but not limited to a webbing. The flexible carrier 112 is configured to allow the plurality of lighting units and the flexible carrier to be folded onto itself in a serpentine configuration forming a folded array of lighting units 153. The lighting units of the folded array 153 can also be comprised of lighting units 300 and is not intended to be limited to lighting units 110.

Conventional lighting units are typically arranged as a number of individual lighting units stored in a box or other container, wherein a packaging material has a plurality of slots that receives and holds a respective lighting unit. The packaging material holds the individual lighting units so that the lighting units are not damaged during transit or while they are stored in the box. Each of the conventional lighting units have electrical conductors that are not connected to another conventional lighting unit and would need to be connected to another conventional lighting unit to form an array of lighting units when installed.

In order for an installer to fabricate an array of lighting units on a carrier using the conventional lighting units, the installer would have to measure and cut a blank carrier that does not have anything mounted on it. Typical carriers used with conventional lighting units are rigid and not flexible. Next, each lighting unit would have to be individually mounted onto the carrier and then the electrical conductors of each lighting unit would have to be spliced and soldered to the electrical conductors of adjacent lighting units so that the array of lighting units can be electrically connected. The installer could also form the array first, then mount each individual conventional lighting unit of the array onto the carrier. These processes to fabricate an array of conventional lighting units on a carrier are cumbersome and provide many opportunities for mistakes and/or errors to occur. For instance, the installer could improperly solder the electrical conductors between adjacent conventional lighting units resulting in failure, or the installer could incorrectly measure the length of the carrier necessary thereby creating wasted materials. Furthermore, this process likely causes the soldered connection of electrical conductors between adjacent conventional lighting units to be exposed and not be housed within the conventional lighting unit, whereas the exposed center conductor and the crimp terminals in the invention are arranged in an orderly fashion within the lighting unit.

An advantage of the invention is that the configuration of the flexible carrier 112 and the lighting units 110, 300 mounted on the flexible carrier eliminates the opportunities for mistakes and errors in assembling the array of lighting units because the array of lighting units 152, 153 on the flexible carrier 112 is prefabricated and tested to ensure proper operation. Assembly of the array of lighting units on the flexible carrier merely requires the installer to cut the flexible carrier to create the desired array length of lighting units on the flexible carrier. The desired array length of lighting units can then be mounted in the light box housing 102 using any of the methods discussed above. The invention reduces the amount of time required to install the array of lighting units, which is a time and cost-savings advantage over conventional lighting units. There is no need to mount each individual lighting unit 110, 300 onto the flexible carrier 112, or to splice and solder the electrical conductors between adjacent lighting units 110, 300, because such work has already been performed.

The coiled array of lighting units 152 is arranged to be easily packaged in a box 150. FIG. 6*b* shows the coiled array of lighting units 152 in a pizza-type box comprising a cover hingedly attached to the box. However, other types of boxes, containers or structures having different shapes, sizes and configurations can be used; the application is not intended to be limited to a pizza-type box. FIG. 6*b* shows the coiled array of lighting units 152 in the box 150, wherein a storage support structure 154 is placed in the central opening of the coiled array 152. The coiled array of lighting units 152 can be comprised of any number of lighting units 110, 300. In yet other embodiments, the coiled array of lighting units 152 can be comprised of a vast quantity of lighting units such that the coiled array of lighting units 152 is on a spool, reel or similar structure. The folded array 153 is also adapted to be packaged in a box, in a manner similar to the coiled array of lighting units 152.

The storage support structure 154 can be made of many different materials, such as but not limited to, cardboard, metal, plastic, paper, foam or the like. The storage support structure 154 shown in FIG. 6*b*, is shown as having a triangular shape, but the storage support structure 154 is not intended to be limited to a triangular shape. In other embodiments, the storage support structure 154 can be shaped in many different forms, such as circular, quadrilateral or any other polygonal shape. The storage support structure 154 assists the coiled array 152 in maintaining its coiled shape while in the box 150 during storage and/or transit so that the coiled array 152 is not damaged. In some embodiments, the size or shape of the storage support structure 154 can be modified to accommodate different sized coiled arrays 152. For example, the storage support structure 154 can be made bigger or smaller to accommodate coiled arrays 152 of different sizes. The storage support structure 154 can be formed as part of the box 150 or can be a separate element that is removable and not part of the box 150.

In other embodiments, the coiled array 152 could be stored within the box 150 without the storage support structure 154, wherein at least one bracket 156 is wrapped around part of the coiled array 152 in order to maintain the coiled shaped. The at least one bracket 156 can be made of many different materials, such as but not limited to, plastic, rubber, paper, metal, steel or the like. Additionally, the at least one bracket 156 can be in many different forms, for example, the at least one bracket 156 can be overmolded material that wraps around part of the coiled array 152, a rubber band, a clip, tape, zip-ties, string, wire, rope or the like. Furthermore, the at least one bracket 156 can be configured to be reusable such that the at least one bracket 156 can be removed from the coiled array 152 and then placed back on the coiled array 152. While in other embodiments, the at least one bracket 156 is arranged to be a one-time use bracket. In yet other embodiments, the coiled array 152 could be stored within the box 150 using both the storage support structure 154 and the at least one bracket 156.

The flexible carrier 112 of the coiled array 152 is also arranged such that the flexible carrier 112 is not permanently shaped or bent due to being coiled, or due to being coiled for an extended period of time. The flexible carrier 112 has sufficient elasticity such that when a desired length of the coiled array 152 is uncoiled and detached from the coiled array 152, forming an array of lighting units of desired length, the flexible carrier 112 of the newly formed array is substantially flat and is not permanently curved or bent in a shape that is similar to the shape of the coiled array 152.

The coiled flexible carrier 112 and plurality of lighting units 110, 300 provide an extended length of coiled lighting units 110, 300 that can be cut to a desired length of an array of lighting units. The desired length of the array of lighting units are easy to install in a light box housing due to the array of lighting units being prefabricated, thereby eliminating the need for an installer to measure and cut a desired length of a carrier and then mount the lighting units onto the desired length of the carrier. As such, the flexible carrier and plurality of lighting units increases the efficiency of installing the array of lighting units in light box housings 102 or the like.

Although the invention has been described in considerable detail with reference to certain configurations thereof, other versions are possible. Lighting units according to the invention can be many different sizes and can be used for many different applications beyond light boxes. In other embodiments, a variable power supply can be used to control the intensity of the light emitting elements. The conductors can be different lengths and instead of running uninterrupted between the units. This would allow the power of the lighting units to be supplied separately and then connected together when installed. Therefore, the spirit and scope of the invention should not be limited to the versions described above.

We claim:

1. A lighting system, comprising:

a light box housing including a light transmissive face, a back, and a plurality of sidewalls separating said face and said back;

a plurality of interconnected lighting units on at least two elongated and continuous woven flexible carriers in said light box housing and separated by a space, each of said lighting units spanning said space, and comprising conductors to provide an electrical signal to each of said units, each of said plurality of lighting units comprising:

a plurality of light emitting elements; and a printed circuit board (PCB) spanning said space and mounted to said carriers, wherein said plurality of light emitting elements are on said PCB and adapted to emit light substantially away from said PCB and toward said light transmissive face in response to said electrical signal;

a plurality of clamps, each of which is mounted a respective end of one of said carriers; and a mounting mechanism comprising at least one pair of mounting brackets arranged to secure at least one array of said plurality of interconnected lighting units on said at least two elongated woven flexible carriers to said light box housing, wherein each of said clamps is coupled to one of said mounting brackets, wherein each of said mounting brackets comprises a base and at least one leg extending from said base that provides an extended surface such that endpoints of said at least one array are coupled to a respective mounting bracket at a desired position along said extended surface of a respective at least one leg, wherein said mounting bracket is directly coupled to one of said plurality of sidewalls of said light box housing.

2. The lighting system of claim 1, wherein said plurality of lighting units are on two elongated woven flexible carriers, such that each of said plurality of lighting units are aligned with each other.

3. The lighting system of claim 1, wherein said carriers comprise a plurality of carrier holes and each of said PCBs comprises at least two slots, wherein each of said carrier holes is aligned with a respective one of said slots in order to couple said PCBs to said carriers.

4. The lighting system of claim 3, wherein the aligned slots and carrier holes are adapted to receive a fastener in order to couple each of said PCBs to said carriers.

5. The lighting system of claim 1, further comprising a housing adapted to cover at least part of said PCB, said conductors and said carriers.

6. The lighting system of claim 5, wherein said housing is an overmold housing overmolded onto at least part of said PCB, conductors and said carriers.

7. The lighting system of claim 1, wherein said conductors are an elongated length of conductors in electrical connection with each of said plurality of lighting units.

8. The lighting system of claim 7, wherein each PCB of said plurality of lighting units comprises a pair of crimp terminals, wherein said conductors are center-stripped such that an exposed center conductor of said conductors is received by a respective one of said pair of crimp terminals.

9. The lighting system of claim 1, said at least one pair of mounting brackets mounted to opposing sidewalls of said light box housing, wherein said base is mounted to said sidewall of said light box housing and said plurality of lighting units are mounted to said at least one leg of each of said opposing mounting brackets.

10. The lighting system of claim 1, wherein at least one of said plurality of clamps is arranged to receive respective ends of said carriers in order to mount said plurality of lighting units to said opposing mounting brackets.

11. The lighting system of claim 10, said at least one of said plurality of clamps comprising:

a front plate;

a back plate, wherein each of said front and back plate comprise a plurality of recesses, a plurality of projections and at least one aperture; and a hinge, wherein said front plate is hingedly coupled to said back plate;

wherein said back plate comprises a stop and said front plate comprises a tongue, such that said tongue is adapted to be received by said stop when said clamp is closed, whereby said clamp is coupled to said respective end of said at least one elongated woven flexible carrier.

12. The lighting system of claim 11, wherein said plurality of projections of said front and back plate adapted to contact a respective side of one of said carriers and hold a respective one of said carriers in place when said clamp is closed.

13. The lighting system of claim 11, wherein said at least one aperture of said front and back plate adapted to form a channel when said clamp is closed.

14. The lighting system of claim 13, wherein said channel is adapted to receive a bolt in order to mount said clamp to said mounting bracket.

15. The lighting system of claim 11, wherein said plurality of recesses of said front and back plates adapted to form a pocket on opposing ends of said clamp when said clamp is closed.

16. The lighting system of claim 15, wherein each of said plurality of lighting units further comprising a housing adapted to cover at least part of a respective one of said carriers proximate said PCB, said housing comprising a first shoe and a second shoe on opposite sides of said housing.

17. The lighting system of claim 16, wherein one of said first or second shoe is disposed within one of said plurality of recesses of said front or back plates such that said first or second shoe is received by said pocket of said clamp when said clamp is closed.

18. The lighting system of claim 1, wherein said plurality of light emitting elements are on the same side of said PCB, such that each of said plurality of lighting units is arranged in a single-sided configuration.

19. The lighting system of claim 1, wherein said plurality of light emitting elements are on both sides of said PCBs, such that each of said plurality of lighting units is arranged in a double-sided configuration.

20. The lighting system of claim 19, wherein each of said plurality of lighting units comprises a conductor on each side of said PCB to provide said electrical signal to said light emitting elements on both sides of said PCB.

21. The lighting system of claim 1, wherein each of said carriers is comprised of a webbing formed of strong fabric woven as a flat strip.

22. The lighting system of claim 21, wherein each of said carriers is a multi-paneled webbing.

23. The lighting system of claim 21, wherein said webbing is flexible and able to provide structural support to said lighting units.

24. An array of lighting units, comprising:

at least one elongated woven flexible carrier;

a plurality of lighting units mounted to said at least one elongated woven flexible carrier, wherein an array of said plurality of lighting units is adapted to be individually mounted, wherein said plurality of lighting units are electrically connected to each other in a daisy-chain configuration, each of said lighting units comprising:

a printed circuit board (PCB) coupled to said at least one elongated woven flexible carrier by a fastener passing through said PCB and carrier;

a plurality of light emitting elements on at least one side of said PCB;

first and second electrical conductors coupled to said PCB and arranged to provide an electrical signal to each of said plurality of light emitting elements; and an overmold housing adapted to enclose at least part of said at least one woven flexible carrier that extends from opposing edges of said PCB, said overmold housing comprising a first shoe and a second shoe that enclose said at least one woven flexible carrier within said overmold housing proximate said opposing edges of said PCB, said overmold housing also enclosing at least part of said PCB and a portion of said conductors;

wherein said at least one elongated woven flexible carrier can bend freely in many different directions;

wherein said plurality of lighting units and said at least one elongated woven flexible carrier are adapted to be coiled to form a coiled array of lighting units;

wherein said at least one elongated woven flexible carrier arranged to be comprised of a plurality of elongated woven flexible carriers coupled together;

wherein respective ends of said plurality of elongated woven flexible carriers are coupled together using a coupler, said coupler comprising:

a back plate;

at least one front plate; and a hinge, wherein said at least one front plate is hingedly coupled to said back plate by said hinge.

25. The array of lighting units of claim 24, wherein said at least one elongated woven flexible carrier comprises a plurality of carrier holes spaced apart, such that said PCBs are mounted to said at least one elongated woven flexible carrier about said carrier holes such that said lighting units are spaced apart along said at least one elongated woven flexible carrier.

26. The array of lighting units of claim 25, wherein the positioning of said lighting units can be adjusted by mounting said PCB to different carrier holes of said at least one elongated woven flexible carrier.

27. The array of lighting units of claim 24, wherein said back plate comprises a plurality of recesses, a plurality of projections and an opening proximate the projections, wherein said front plate comprises an aperture, a recess, a plurality of projections and an indentation.

28. The array of lighting units of claim 27, wherein said indentations are arranged to be aligned with said opening to form a groove when said coupler is closed, wherein said groove adapted to receive a bolt to mount said coupler to a structure or surface.

29. The array of lighting units of claim 27, wherein said plurality of projections of said front and back plates adapted to contact a respective side of said at least one elongated woven flexible carrier, wherein a pin can be received by said aperture of said front plates in order to hold said at least one elongated woven flexible carrier in place when said coupler is closed.

30. The array of lighting units of claim 27, wherein said recesses of said front and back plates adapted to form a pocket on opposing ends of said coupler when said coupler is closed.

31. The array of lighting units of claim 30, said housing covering at least part of said PCB, wherein said first shoe and said second shoe are on opposite sides of said housing.

32. The array of lighting units of claim 31, wherein one of said first or second shoe is disposed within one of said recesses of said front or back plates such that said first or second shoe is received by said pocket of said coupler when said coupler is closed.

33. The array of lighting units of claim 24, said housing covering at least part of said PCB and part of said first and second electrical conductors proximate said PCB.

34. The array of lighting units of claim 24, wherein said at least one elongated woven flexible carrier is comprised of a webbing formed of woven fabric.

35. The array of lighting units of claim 24, wherein said at least one elongated woven flexible carrier is formed of cotton, nylon, polyester, polypropylene, or a combination thereof.

36. The array of lighting units of claim 24, wherein said coiled array of lighting units is arranged to provide an extended length of fully assembled and electrically connected array of lighting units on said at least one elongated woven flexible carrier.

37. The array of lighting units of claim 24, further comprising at least one bracket around part of said coiled array of lighting units, wherein said at least one bracket adapted to maintain the coiled shape of said coiled array of lighting units.

38. The array of lighting units of claim 24, wherein said at least one elongated woven flexible carrier is adapted to be substantially flat when said coiled array of lighting units is uncoiled.

39. The array of lighting units of claim 24, wherein said coiled array of lighting units is adapted to be packaged in a box, wherein a storage support structure is arranged in a central opening of said coiled array of lighting units.

40. The array of lighting units of claim 39, wherein said box is a pizza-type box.

41. The array of lighting units of claim 39, wherein said storage support structure is adapted to maintain the coiled shape of said coiled array of lighting units.

42. The array of lighting units of claim 39, wherein said storage support structure is adapted to be modified, such that the shape or size said storage support structure can be adjusted to accommodate different coiled arrays.

43. The array of lighting units of claim 39, wherein said box comprises said storage support structure.

44. The array of lighting units of claim 39, wherein said storage support structure is a separate element, such that said storage support structure is removable from said box.

45. The array of lighting units of claim 24, wherein said coiled array of lighting units is adapted to be packaged on a spool.

46. A lighting system, comprising:

a light box housing including a light transmissive face, a back, and a plurality of sidewalls separating said face and said back;

a plurality of interconnected lighting units on at least one elongated woven flexible carrier in said light box housing, and comprising conductors to provide an electrical signal to each of said units, each of said plurality of lighting units comprising:

a plurality of light emitting elements; and a printed circuit board (PCB) mounted to said carrier, wherein said plurality of light emitting elements are on said PCB and adapted to emit light substantially away from said PCB and toward said light transmissive face in response to said electrical signal;

a plurality of clamps, each of which is mounted to a respective end of said carrier, and each clamp comprising a front plate and a back plate arranged for securely holding said carrier end there between; and at least one pair of mounting brackets arranged to secure at least one array of said plurality of interconnected lighting units on said at least one elongated woven flexible carrier to said light box housing, wherein each of said clamps is coupled to one of said mounting brackets, wherein each of said mounting bracket is directly coupled to one of said plurality of sidewalls of said light box housing.

47. A lighting system, comprising:

a light box housing including a light transmissive face, a back, and a plurality of sidewalls separating said face and said back;

a plurality of interconnected lighting units on at least two elongated and continuous woven flexible carriers in said light box housing and separated by a space, said carriers having carrier holes, each of said lighting units spanning said space, and comprising conductors to provide an electrical signal to each of said units, each of said plurality of lighting units comprising:

a plurality of light emitting elements;

a printed circuit board (PCB) spanning said space and mounted to said carriers and having a plurality of slots, wherein said plurality of light emitting elements are on said PCB and adapted to emit light substantially away from said PCB and toward said light transmissive face in response to said electrical signal;

an overmolded housing enclosing part of the woven flexible carriers, part of the PCB and part of the conductors; and a plurality of fasteners, each of which cooperates with a respective hole and slot to mount each said PCB to said carriers; and a pair of mounting brackets arranged to secure at least one array of said plurality of interconnected lighting units on said at least one elongated woven flexible carrier to said light box housing, and wherein each of said mounting brackets is directly coupled to one of said plurality of sidewalls of said light box housing.

* * * * *